US006094794A

United States Patent [19]

Kuo et al.

[11] Patent Number: 6,094,794

[45] Date of Patent: Aug. 1, 2000

[54] BILLIARD CUE REPAIRING MACHINE

[76] Inventors: Chun-Chen Kuo; Ming-Shyan Kuo, both of 58, Ma Yuan West St., Taichung, Taiwan

[21] Appl. No.: 09/264,365

[22] Filed: Mar. 8, 1999

[51] Int. Cl.[7] ..... B23P 23/00

[52] U.S. Cl. ..... 29/33 R

[58] Field of Search ..... 29/33 R, 33 K; 451/552; 144/330, 134.1, 346; 142/1, 48, 55; 30/494; 473/49

[56] References Cited

U.S. PATENT DOCUMENTS

| | | | |
|---|---|---|---|
| 4,471,824 | 9/1984 | Zownir | 144/330 |
| 4,987,936 | 1/1991 | Calabrese | 144/346 |
| 5,208,985 | 5/1993 | Carter | 30/494 |
| 5,228,160 | 7/1993 | Porper | 451/552 X |
| 5,694,669 | 12/1997 | Porper | 29/33 R |

*Primary Examiner*—William Briggs

[57] ABSTRACT

A billiard cue repairing machine includes planing device, an edge cutting device, a micro-cutting device, and an end cutting device to allow for repair of a billiard cue in an automated fashion. The billiard cue is held in position by a cue clamping mechanism. A drive element drives is used to rotate the billiard cue and the micro-cutting device. The planing device and the edge cutting device are respectively disposed on both sides of a to-be-repaired end of the billiard cue, with adjacent sides provided with a plane knife and a cutter, respectively. The planing device is manually controllable by means of a first axial gear mechanism to cause its cutter to cut the to-be-repaired end of the billiard cue to form a rod adapted to receive a plastic sleeve. The edge cutting device has a second axial gear mechanism and an elastic transverse displacement mechanism that displace in directions substantially perpendicular to each other. By means of the elastic transverse displacement mechanism, a cutter is manually controllable to urge against the to-be-repaired end of the billiard cue. The axial gear mechanism is used to control the elastic transverse displacement mechanism to displace in the other direction to cut the uneven portions of the billiard cue and the plastic sleeve. The micro-cutting device utilizes a rotary disk to carry a rubber head so as to allow cutting of an uneven bottom side of the rubber head by a cutter. The end cutting device is utilized to cut the uneven portions of the rod and plastic sleeve to make them even to facilitate adhering of the rubber head.

4 Claims, 22 Drawing Sheets

BILLIARD CUE REPAIRING MACHINE

BACKGROUND OF THE INVENTION (a) Field of the Invention

The present invention relates to a billiard cue repairing machine that has high precision and accuracy, and that is time-saving and labor-saving.

(b) Description of the Prior Art

As a billiard cue is constantly subjected to strong impacts and may be used improperly occasionally, the top of the billiard cue that is in direct contact with the balls is vulnerable to damage, cracking or breaking. As a result, the billiard cue cannot be used anymore and must be replaced by a new one or repaired. As a general rule, a professional repair technician is sought to carry out precision repair of the billiard cue.

Referring to FIG. 1, a billiard cue S includes an elongate shaft S1, a rod S2 of a smaller diameter formed at an end portion of the shaft S1, a plastic sleeve S3 fitted over the rod S2, and a rubber head S4 that is adapted to give outer ends of the rod S2 and the plastic sleeve S3 a flushed appearance and that is adhered to where the outer ends of the rod S2 and the plastic sleeve S3 flush.

The steps taken by a professional technician in repairing a billiard cue generally are: Cutting off the damaged or cracked portion of the billiard cue; trimming and grinding the tip to be repaired with a sand cloth so as to form a part of the rod S2, striking the plastic sleeve S3 with a hammer so that it fits over the rod S2, grinding the shaft S1 and the plastic sleeve S3 that are of different diameters until they flush, polishing the tip of the rod S2 fitted with the plastic sleeve S3 and the side of the rubber head S4 to be adhered using a sand cloth, and adhering the rubber head S4 to the tip of the rod S2 fitted with the plastic sleeve S3. As the repairing steps are done manually, they must be entrusted to a professional billiard cue repair technician. Besides, the repairing process is time-consuming and troublesome.

SUMMARY OF THE INVENTION

Therefore, a primary object of the present invention is to provide a billiard cue repairing machine that allows for mechanical repair of billiard cues to save time and labor. Besides, the precision in repair is enhanced, which is not easily achieved by a technician.

Another object of the present invention is to provide a billiard cue repairing machine, in which an automated micro-cutting device is employed to perform the job of grinding rubber heads of billiard cues in an easier and more precise manner than the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
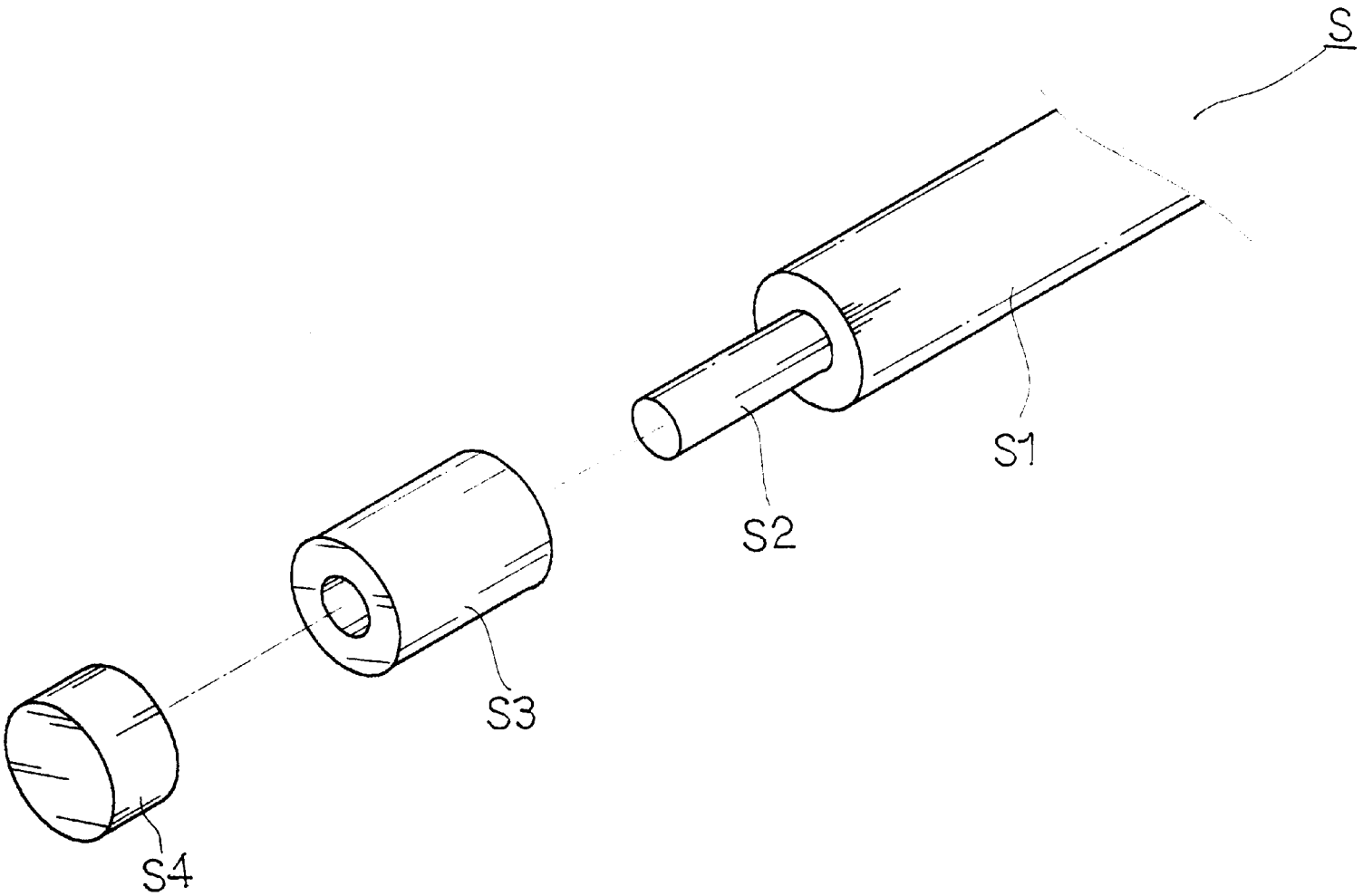
FIG. 1 is a schematic view showing the structure of a billiard cue.
Figure 2:
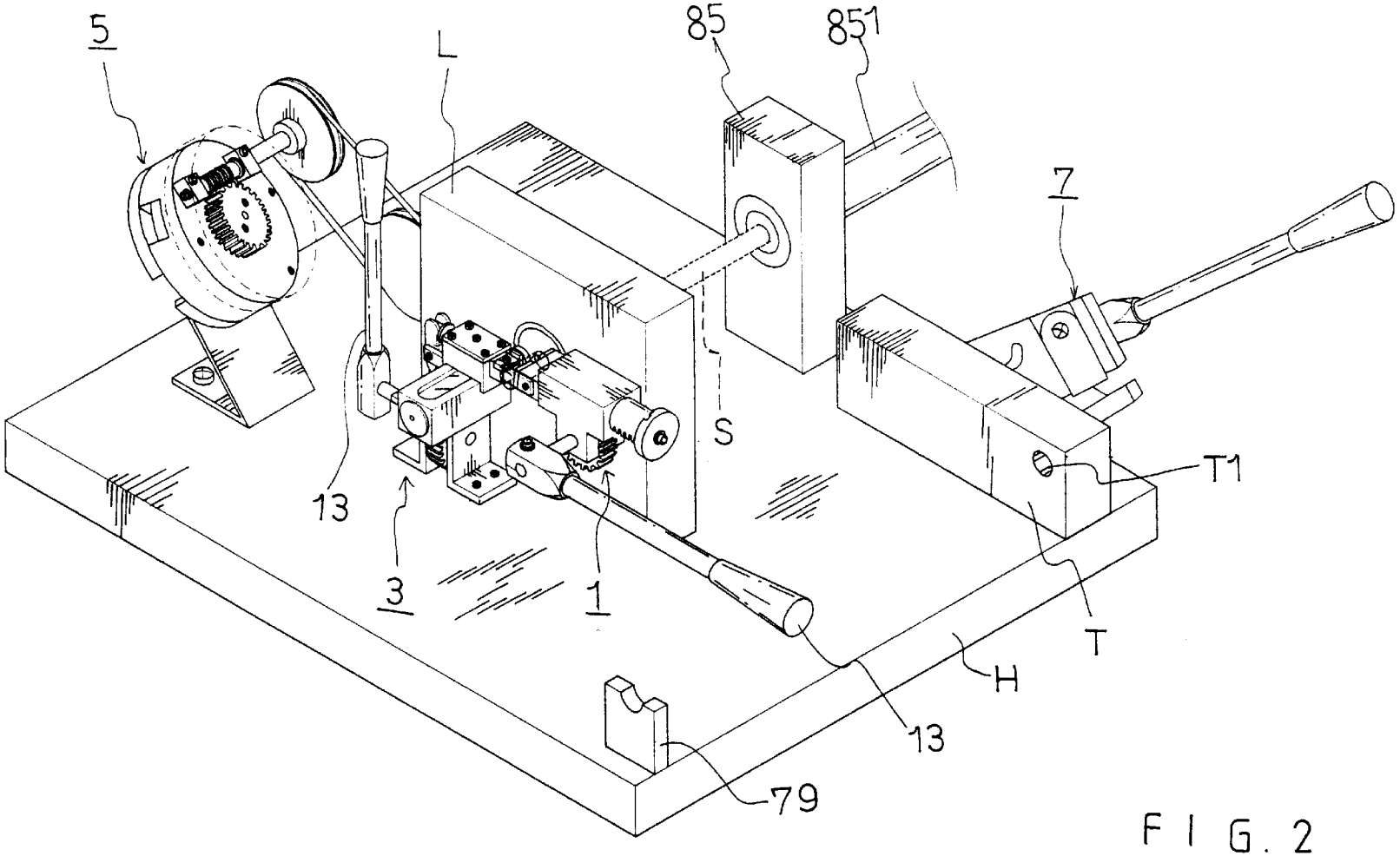
FIG. 2 is a perspective view of the present invention.
Figure 2A:
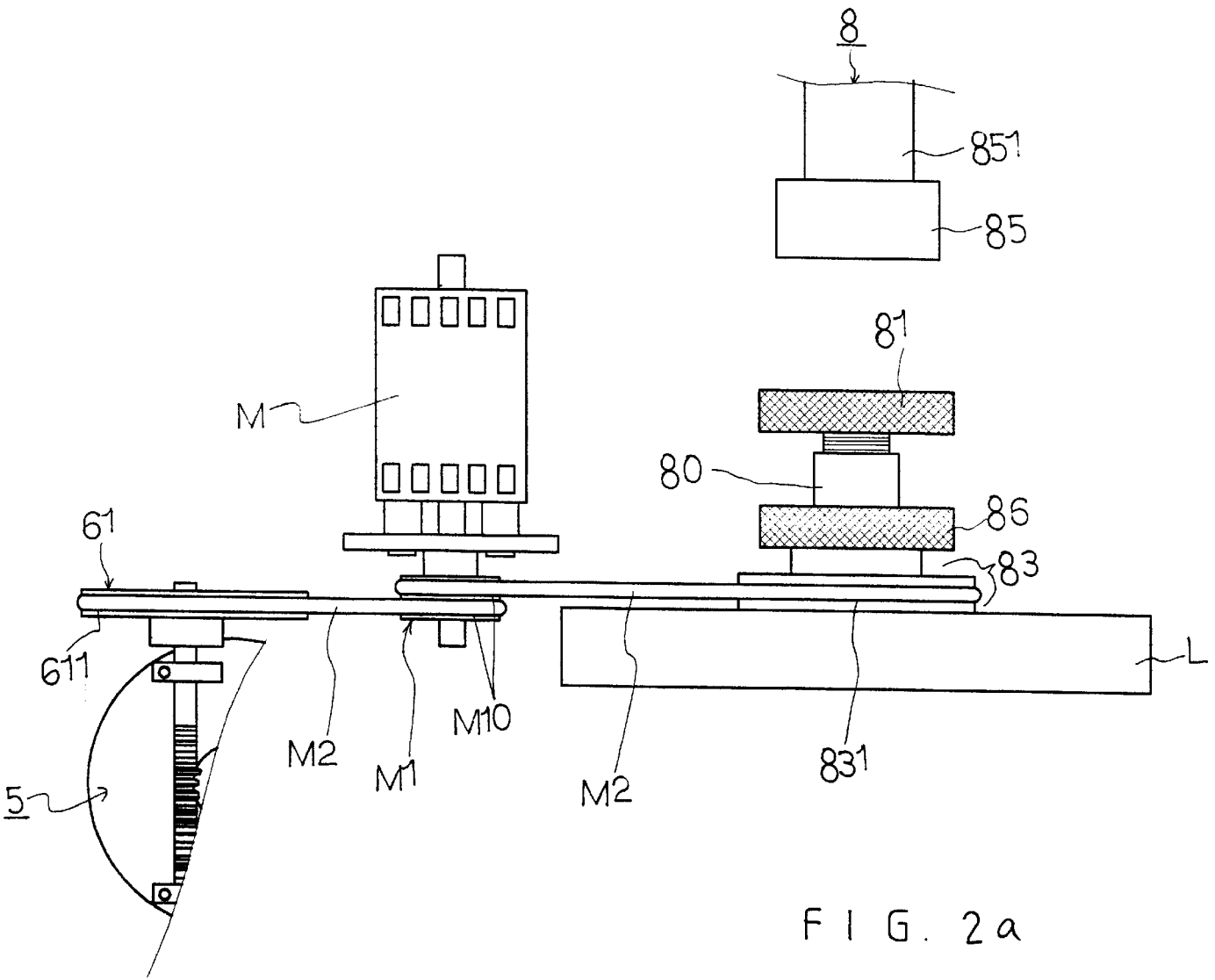
FIG. 2*a* is a top view of the present invention of FIG. 2 in part, showing a driving element.

Referring to FIGS. 2 and 2*a*, a preferred embodiment of a billiard cue repair machine according to the present invention comprises a repair machine body that includes a work table H, and a longitudinal plate L, an elongate plate T, a driving element M, a cue clamping mechanism 8 (see FIG. 2*a*), a planing device 1, an edge cutting device 3, a micro-cutting device 5, and an end cutting device 7 secured vertically to the work table H.

The longitudinal plate L that is provided vertically on the work table H has an action hole L1 provided substantially at a central portion thereof. A positioning column 85 is fixedly provided on a rear side of the work table H, and has an extension rod 851 that extends transversely therethrough. It is essential that the extension rod 851 and the action hole L1 form a straight line.

The driving element M, as shown in FIGS. 2 and 2*a*, has one end provided with an axle bush M1 that is formed with two first cable receiving grooves M10 for receiving drive cables M2. One of the drive cables M2 connects the axle bush M1 and a driven fitting seat 83 of the cue clamping mechanism 8, while the other of the drive cables M2 connects the axle bush M1 and a driven wheel 61 of the micro-cutting device 6, whereby the driving element M brings the driven fitting seat 83 and the driven wheel 61 to co-rotate therewith (see FIG. 2*a*).

Figure 2B:
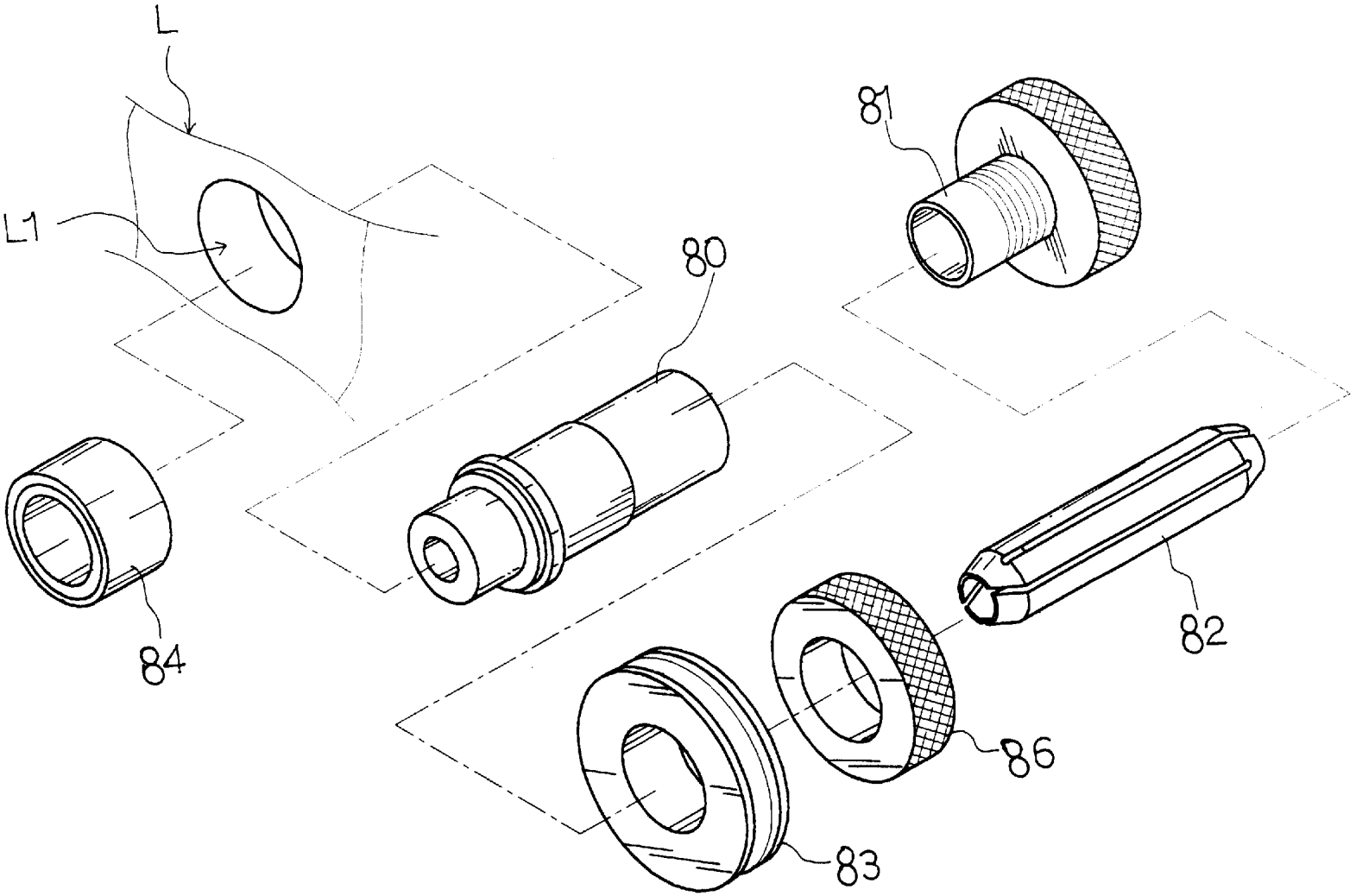
FIG. 2*b* is an exploded view of a cue clamping mechanism of FIG. 2.
Figure 2C:
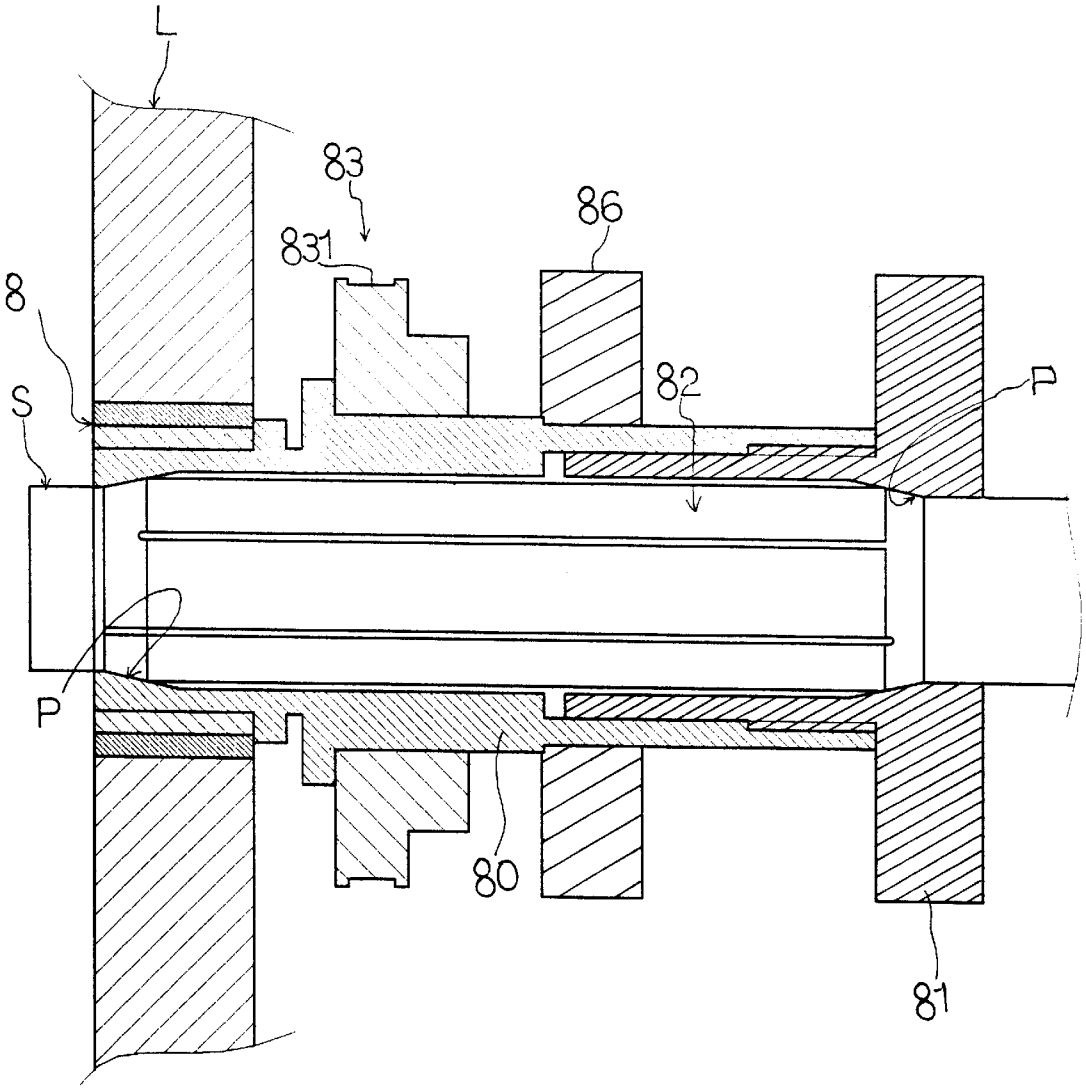
FIG. 2*c* is an assembled rear sectional view of FIG. 2*b;*

The cue clamping mechanism 8, as shown in FIGS. 2*a* and 2*b*, is disposed on a rear side of the longitudinal plate L, and includes a bearing 84 provided in the action hole L1, a hollow fitting post 80 having one end secured in the bearing 84, the above-mentioned driven fitting seat 83 that is fitted over the fitting post 80 and that has a generally T-shape when viewed from one side, an inner screw cap 86 fitted in the fitting post 80, an outer screw cap 81 coupled screwably to the other end of the fitting post 80, and an elastic clamping element 82 planted between the fitting post 80 and the outer screw cap 81. The driven fitting seat 83 has a second cable receiving groove 831 provided on an outer wall thereof. Ends of one of the drive cables M2 are respectively received in a respective one of the first cable receiving grooves M10 and the second cable receiving groove 831, whereby the driven fitting seat 83 can be brought to co-rotate with the driving element M. Referring to FIG. 2*c*, the outer screw cap 81 is driven screwably into a rear end of the fitting post 80. Each of the outer screw cap 81 and the fitting post 80 has an interior formed with opposed tapered edges P on opposite ends thereof. The elastic clamping element 82 is inserted into the interior spaces of the outer screw cap 81 and the fitting post 80. The elastic clamping element 82 is a commercially available product that, when subjected to an external pressure, will contract the two ends thereof. The two ends of the elastic element 82 are configured to be tapered so as to match the tapered edges P of the outer screw cap 81 and the fitting post 80. The contraction of the ends of the elastic clamping element 82 is adjustable by adjusting the extent the outer screw cap 81 is driven onto a rear end of the elastic clamping element 82 and the pressure exerted by the tapered edges P on the ends thereof, whereby the billiard cue disposed inside the elastic clamping element 8 can be clamped tightly and brought to rotate by the cue clamping mechanism 8. When the outer screw cap 81 is being screwably fitted onto the rear end of the elastic clamping element 82, the inner screw cap 86 at the other end of the elastic clamping element can be held to facilitate fitting of the outer screw cap 81.

Figure 3:
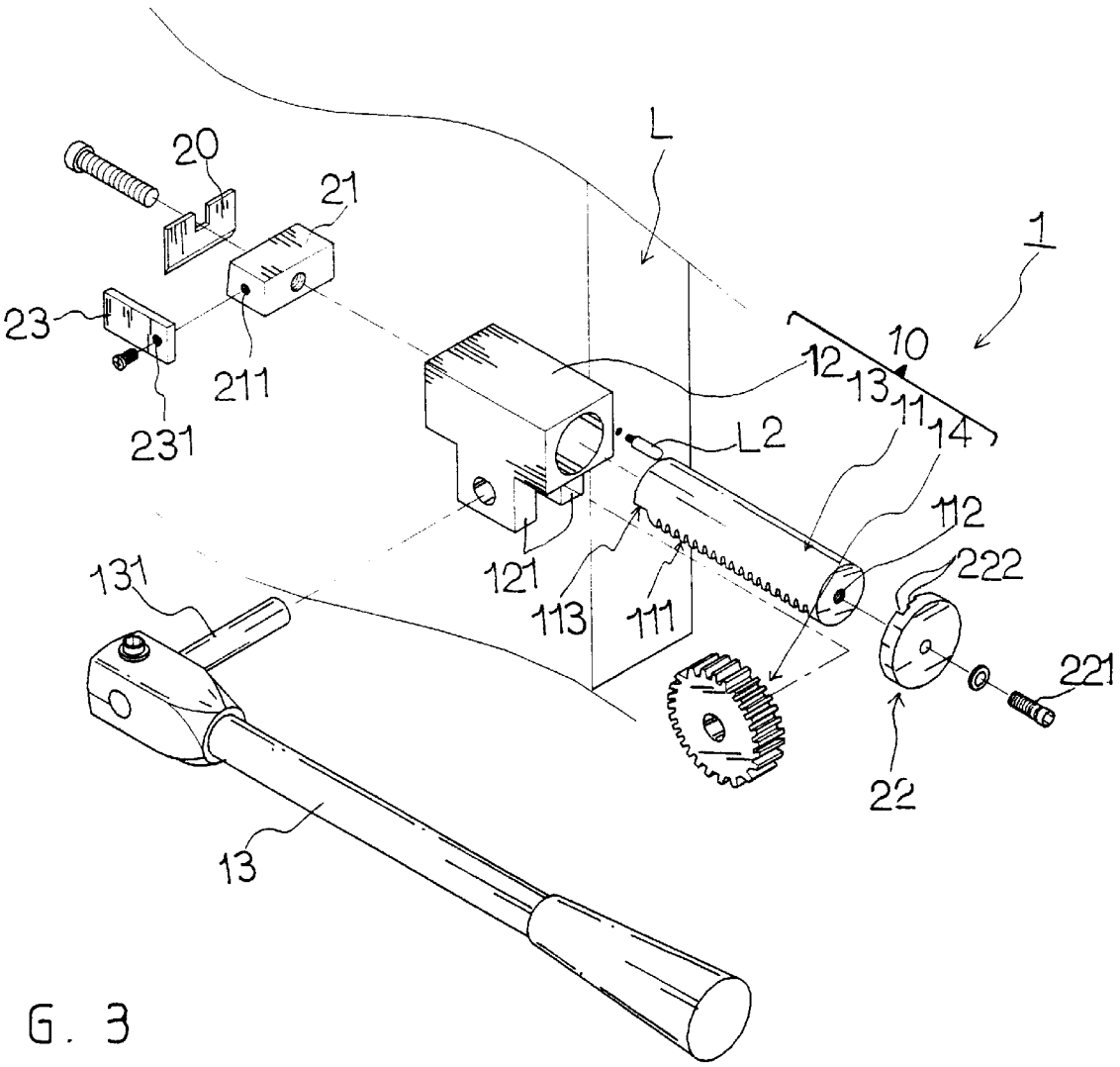
FIG. 3 is an exploded view of a planing device of the present invention.

The planing device 1, as shown in FIG. 3, is disposed on the right side of the action hole L1 of the longitudinal plate L, and includes a first axial gear driving mechanism 10, a plane knife 20 secured at a left end of a central post 11 11 of the first axial gear driving mechanism 10 (proximate to the action hole L1), and a limiting disk 22 axially secured at the other end of the central post 11. The first axial gear driving mechanism 10 includes a hollow outer sleeve 12 secured on the longitudinal plate L, the above-mentioned central post 11 planted into the outer sleeve 12, a ratchet 14 disposed on a bottom side of the outer sleeve 12, and a control rod 13 for controlling rotation of the ratchet 14. The outer sleeve 12 is rectangular and has an opening on the bottom side thereof. On both sides of the opening, there are provided two lower extension plates 121. The central post 11 is cylindrical and has lower ratchet teeth 111 formed on a bottom side thereof to correspond to the ratchet 14. The ratchet teeth 111 are exposed through the opening of the outer sleeve 12. The left end of the central post 11 is formed with a notch portion 113 that is cut upwardly from a lower end thereof. The plane knife 20 is screwably secured to the notch portion 113 by means of a knife holder 21, and has an edge oriented downwardly. The side of the knife holder 21 on which the plane knife 20 is secured is configured to be slanting so as to facilitate the cutting action of the plane knife 20. The knife holder 21 is further provided with a screw hole 211 on a left side thereof for screwable engagement with a stop plate 23 that is correspondingly provided with a screw hole 231. The stop plate 23 can check the cue S so that it will not extend too farther out. A right end of the central post 11 has an axially extending hole 112. By means of a securing screw 221 that is inserted into a central hole of the limiting disk 22 and the axially extending hole 112 of the central post 11, the limiting disk 22 is secured to the central post 11. The limiting disk 22 is provided with two indentations 222 of different depths. On one side of the longitudinal plate L, there is provided an adjusting pin L2 (see FIG. 3*b*) that can fit into the indentations 222 of the limiting disk 22. The indentations 222 cooperate with the adjusting pin L2 to control the distance displaced by the limiting disk 22 and the longitudinal plate L when they approach each other, thereby limiting the maximum distance between the left end of the central post 11 and the action hole L1. The distance thus set is utilized to plane the cue S to obtain a rod S2 of a determined diameter.

Figure 3A:
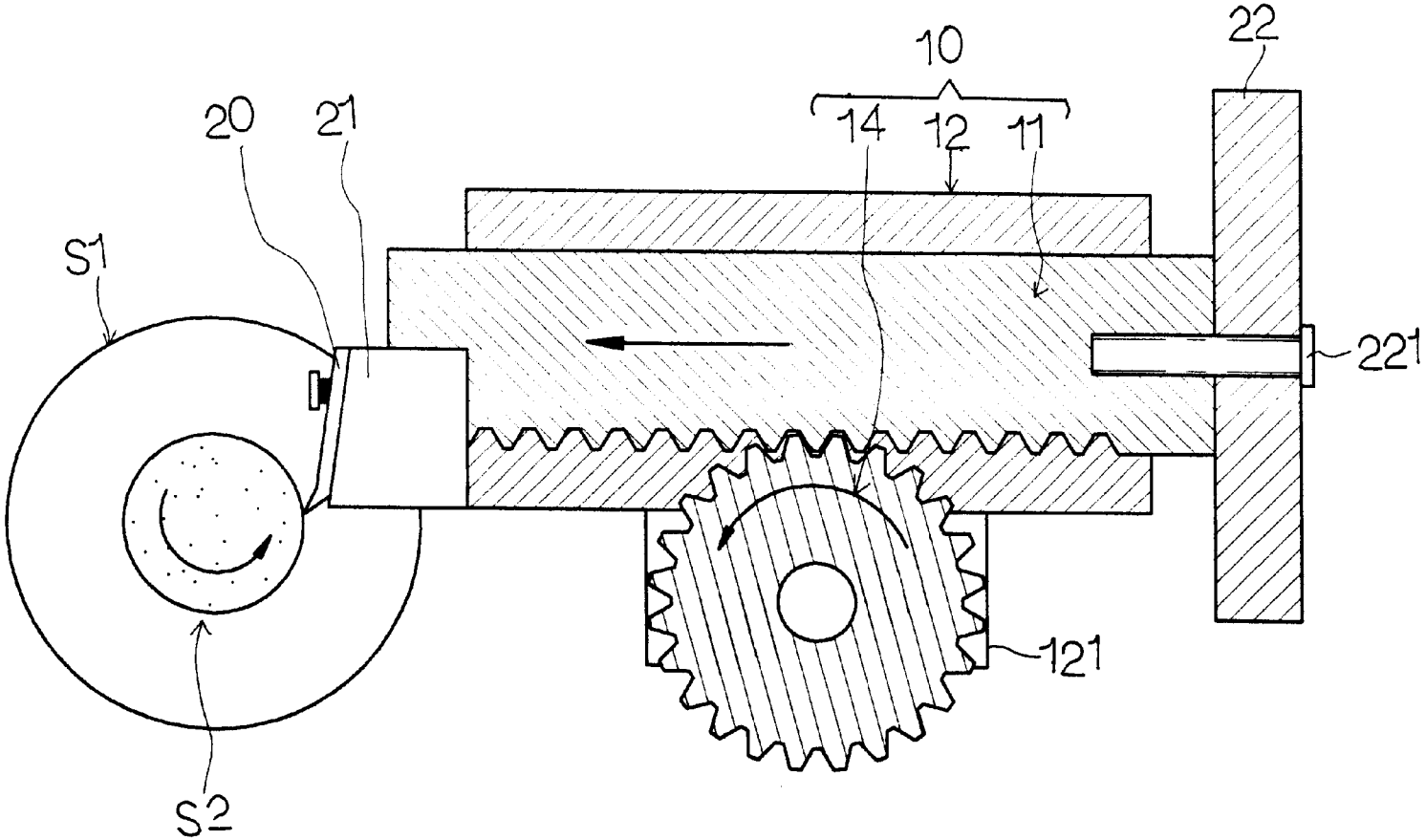
FIG. 3*a* is a partly sectional view of FIG. 3 after assembly.
Figure 3B:
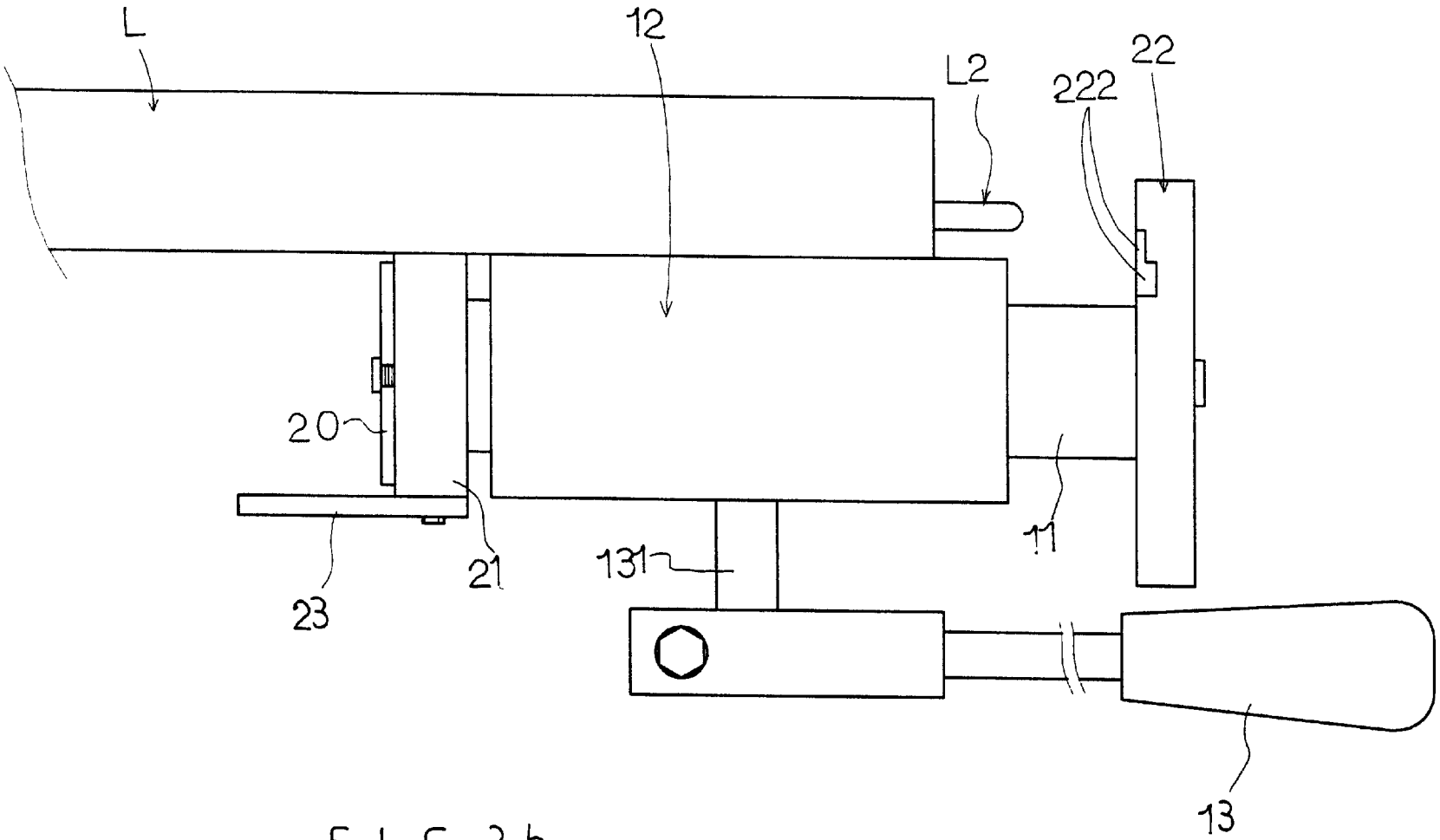
FIG. 3*b* is a top view of FIG. 3*a;*
Figure 3C:
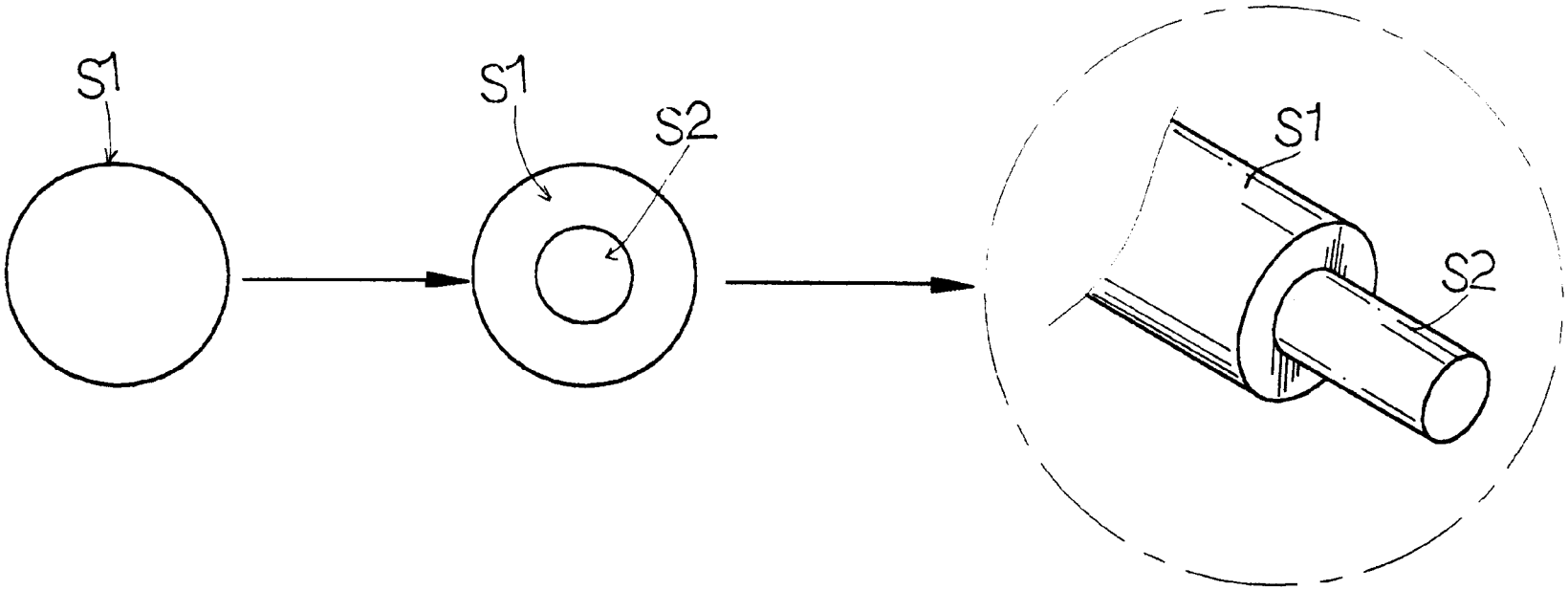
FIG. 3*c* illustrates the billiard cue prior to and after operation of the planing device.

With reference to FIG. 3*a*, a tail end of the control rod 13 has a shaft 131 disposed in a perpendicular relationship to the body of the control rod 13. The shaft 131 is bolted between the two lower extension plates 121 and is connected to the ratchet 14 disposed between the lower extension plates 121. The ratchet 14 engages the ratchet teeth 111 of the central post 11 such that manipulation of the control rod 13 can cause the ratchet 14 to drive the central post 11 to displace left and right. As mentioned above, the maximum distance of displacement of the indentations 222 with respect to the adjusting pin L2 is utilized to set the diameter of the rod S2 of the cue S. By employing the operation illustrated in FIG. 3*a* and the control of the diameter of the rod S2 shown in FIG. 3*b*, a rod S2 of FIG. 3*c* can be accomplished.

Figure 4:
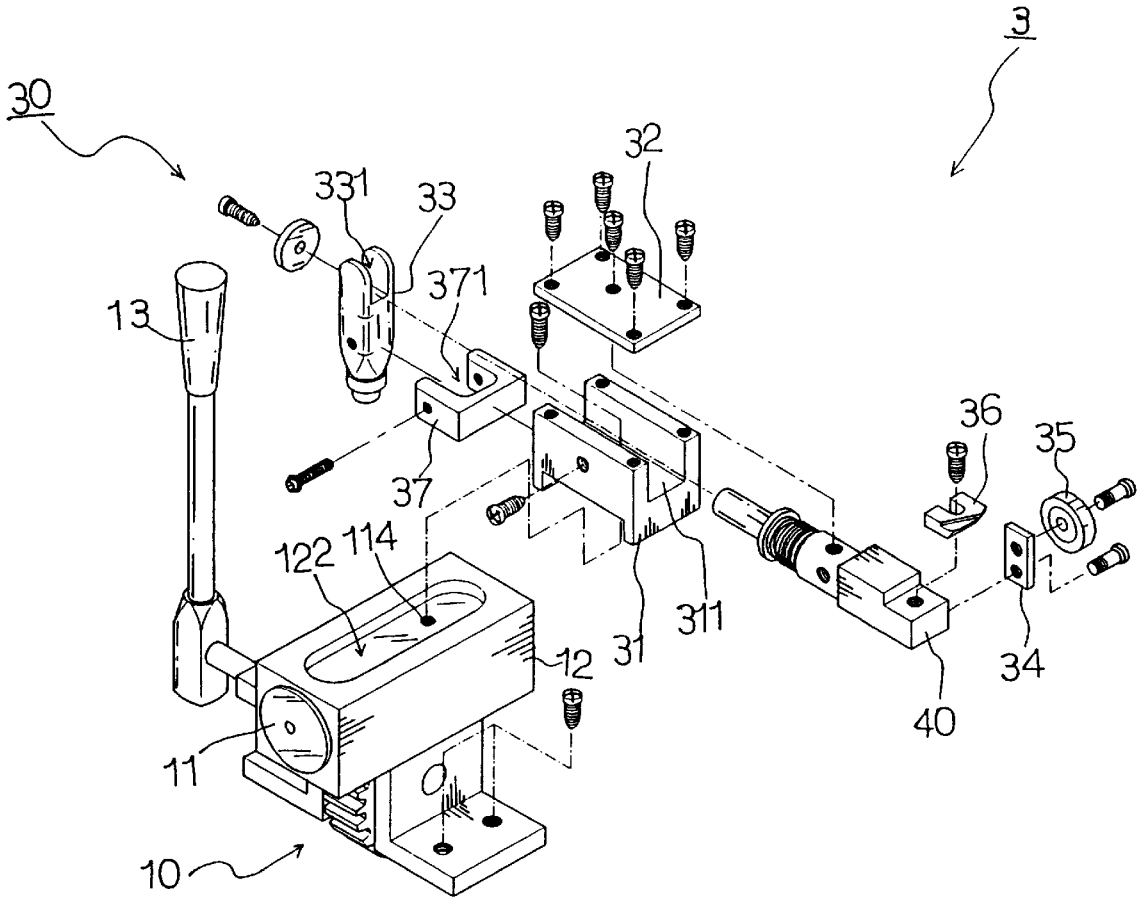
FIG. 4 is an exploded view of an edge cutting device of the present invention.

Referring to FIG. 4, the edge cutting device 3 is provided on the other side of the action hole L1 of the longitudinal plate L (see FIG. 2), and includes a second axial gear mechanism 100 that is the same as the first axial gear mechanism 10 of the planing device 1, an elastic horizontal displacement mechanism 30 that straddles over the second axial gear mechanism 100 and has an elastic shaft 40, and a control rod 130 that controls a central post 110 of the second axial gear mechanism 100 and the elastic shaft 40.

The second axial gear mechanism 100 of the edge cutting device 3 is secured on the work table H in a longitudinal direction. The structure thereof is the same as that of the first axial gear mechanism 10 of the planing device 10 except that an upper side of an outer sleeve 120 is provided with a longitudinally oriented elongate groove 122 that can expose the central post 110. In addition, a moving seat 15 is screwably provided on one side of the outer sleeve 120. The moving seat 15 is provided with a recess 151 against which a lower end of a control rod 33 can abut. An upper side of the central post 110 further has a screw hole 114 in the elongate groove 122. The elastic horizontal displacement mechanism 30 mainly includes a generally inverted U-shaped straddling seat 31, the above-mentioned elastic shaft 40 mounted in the straddling seat 31, and a brake rod 33. The straddling seat 31 has a bottom side thereof straddling over the upper side of the outer sleeve 120. An upper side of the straddling seat 31 is formed with a transverse groove 311 for receiving the elastic shaft 40. The straddling seat 31 is secured on the screw hole 114 of the central post 110 by means of a securing screw 115 in the manner as shown in FIG. 4*b*. By means of the central post 110, the second axial gear mechanism 100 can bring the entire elastic transverse displacement mechanism 30 to displace forwardly and rearwardly.

Figure 4A:
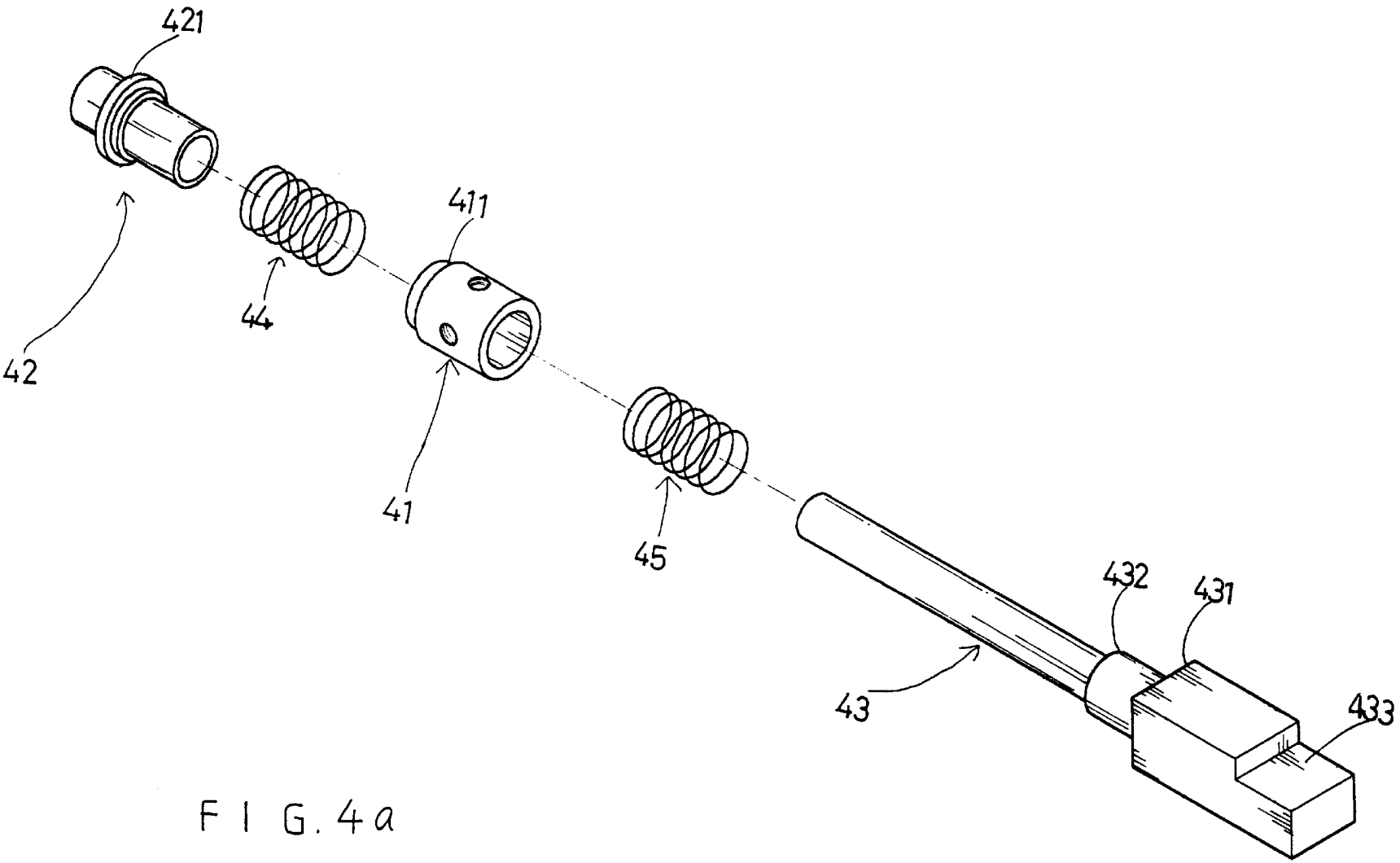
FIG. 4*a* is a perspective exploded view of an elastic shaft of FIG. 4.

Referring to FIG. 4*a*, the elastic shaft 40 has a first section, a third section, and a second section intermediate of the first and third sections. The second section is fixed. The first section is pivotally connected to a tail end of the control rod 33 having a fulcrum point. The third section has a cutter 36 and a bearing 35 provided thereon. The third section has an outer end oriented towards the action hole L1. Outer and inner elastic elements 44, 45 are disposed between the first and second sections and between the second and third sections respectively to enhance the precision of cutting.

Figure 4D:
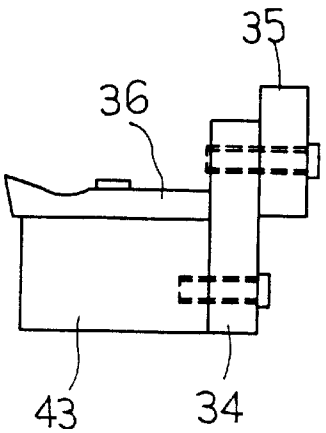
FIG. 4*d* is a side view of a cutter of FIG. 4*b;*
Figure 4B:
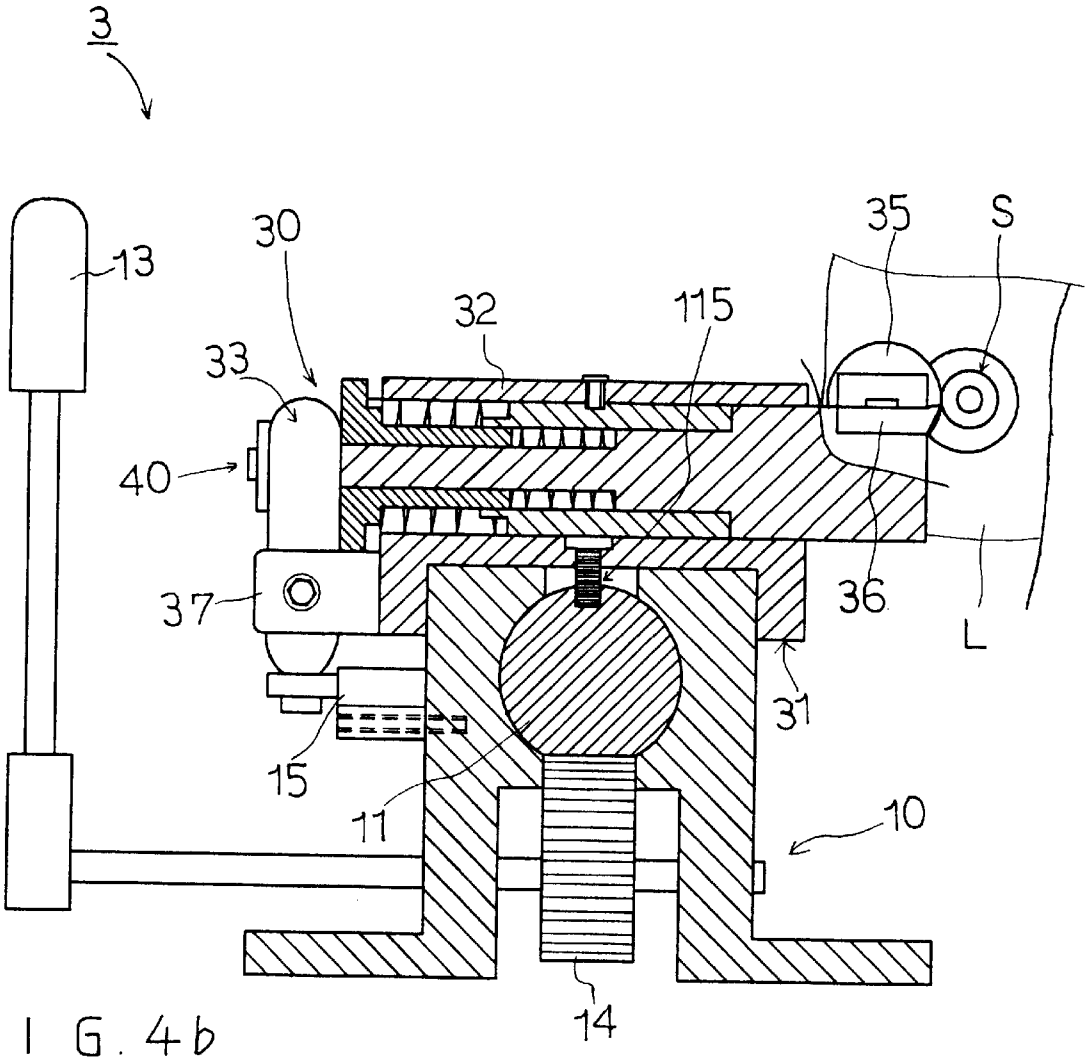
FIG. 4*b* is an assembled sectional view of FIG. 4.
Figure 4C:
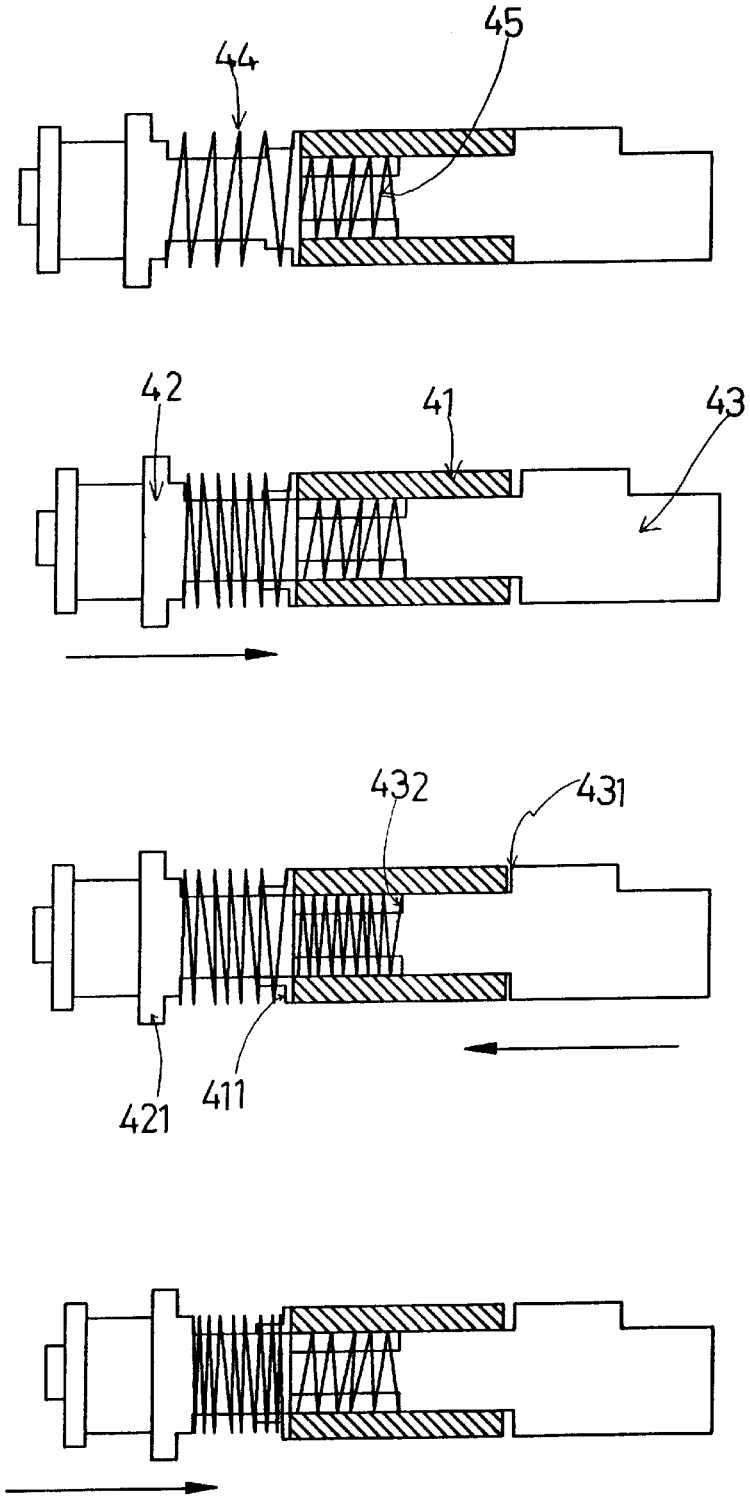
FIG. 4*c* is a schematic view illustrating the operation of the present invention of FIG. 4*b;*
Figure 4E:
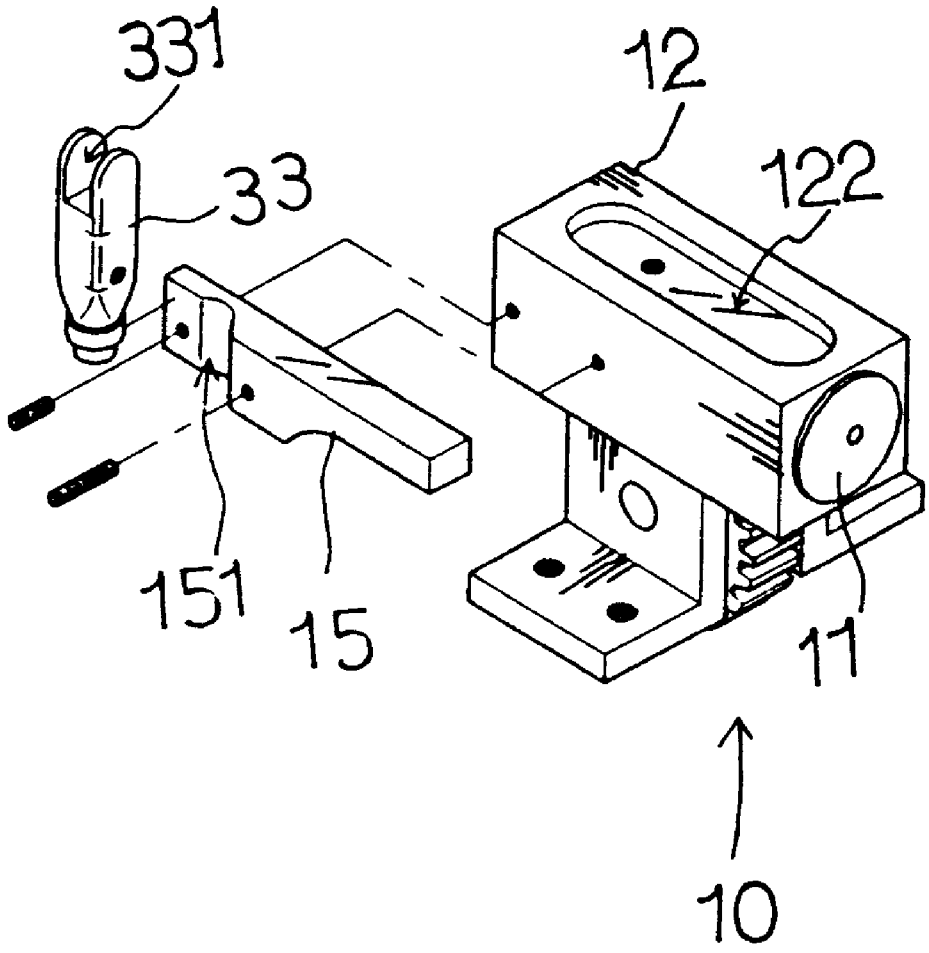
FIG. 4*e* illustrates the first axial gear driving mechanism.

The second section is a hollow second sleeve 41 that is secured on an inner side of the transverse groove 311 and has a left end formed with a flange 411. The third section is a central rod 43 that is inserted via a right end of the first sleeve 41 and has a larger flange 431 and a smaller flange 432. The first section is a hollow first sleeve 42 that is inserted via a left end of the second outer sleeve 41 and has a left end provided with a flange 421. Referring to FIG. 4*b*, after assembly, the larger flange 431 of the central rod 43 abuts against the right end of the second sleeve 41; the smaller flange 432 is located inside the second sleeve 41; the left end of the central rod 43 extends out of the second sleeve 41; the first sleeve 42 at the leftmost end of the elastic shaft 40 is fitted into the left end of the central rod 43 and inserted into the second sleeve 41 from the left end. The inner and outer elastic elements 45, 44 are disposed respectively between the smaller flange 432 of the central rod 43 and the right end of the first sleeve 42, and between the flange 421 at the left end of the first sleeve 42 and the flange 411 at the left end of the second sleeve 41. An upper edge of the right end of the central rod 43 is formed with a notch 433 and has the above-mentioned cutter 36 screwably secured in the notch 433, the edge of the cutter 36 being oriented towards the action hole L1. A rear side of the left end of the central rod 43 has the above-mentioned bearing 35 provided thereon by means of a projecting block 34, the edge of the bearing 35 being flushed with the edge of the cutter 36 (as shown in FIGS. 4*b* and 4*d*), whereby and in combination with the two elastic elements 45, 44 on the elastic shaft 40, the bearing 35 can be utilized to contact that part of a cue shaft S1 of the cue S that needs not to be cut, thereby restricting the cutting length of the part of the cue shaft S1. In other words, the bearing 35 functions as a sensor. No matter how the control rod 33 pushes out the cutter 36 repeatedly, due to the bearing 35 that abuts against the cue shaft S1 and the elastic compressing force of the inner elastic element 45, and since the brake rod 33 has a substantially intermediate section bolted to a recess 371 of a locking seat 37 at a left end of the straddling seat 31, the first sleeve 42 and the central rod 43 are controlled by the outer elastic element 44 to extend towards the right side of the straddling seat. Furthermore, by means of the inner elastic element 45 and the bearing 35 that abuts against the cue shaft S1, the central rod 43 can extend or retract elastically. In addition, as the central rod 43 is disposed in an U-shaped seat 331 of the brake rod 33, the force with which the brake rod 33 pushes the elastic shaft 40 is a result of the brake rod 33 being rotated simultaneously to cause the elastic shaft 40 to elastically move when the control rod 130 pushes the central post 110 to axially displace due to the coupling of the straddling seat 31 with the central post 110. FIG. 4*c* shows the four stages of action of the elastic shaft 40, namely, a normal state; pushing out towards the right end; right end being subjected to a force and pushed back; and right end resetting elastically to original length due to release of force. In the first stage, as the second outer sleeve 41 is fixed and prevented from moving, an upper cover 32 can be screwably disposed on the second outer sleeve 41 to more firmly secure the second outer sleeve 41 in the transverse groove 311. In the second stage, the left end pushes towards the right end by means of the brake rod 33 (the outer elastic clement 44 retracting), so that the right end and the second outer sleeve 41 define a clearance therebetween. In the third stage, the left end remains stationery as the right end abuts against he cue S and retracts (the inner elastic element 45 retracting). In the fourth stage, if the force applied to the left end unduly increases and the left end pushes to towards the right end, the right end will remain unmoved due to the action of the bearing 35.

Figure 6:
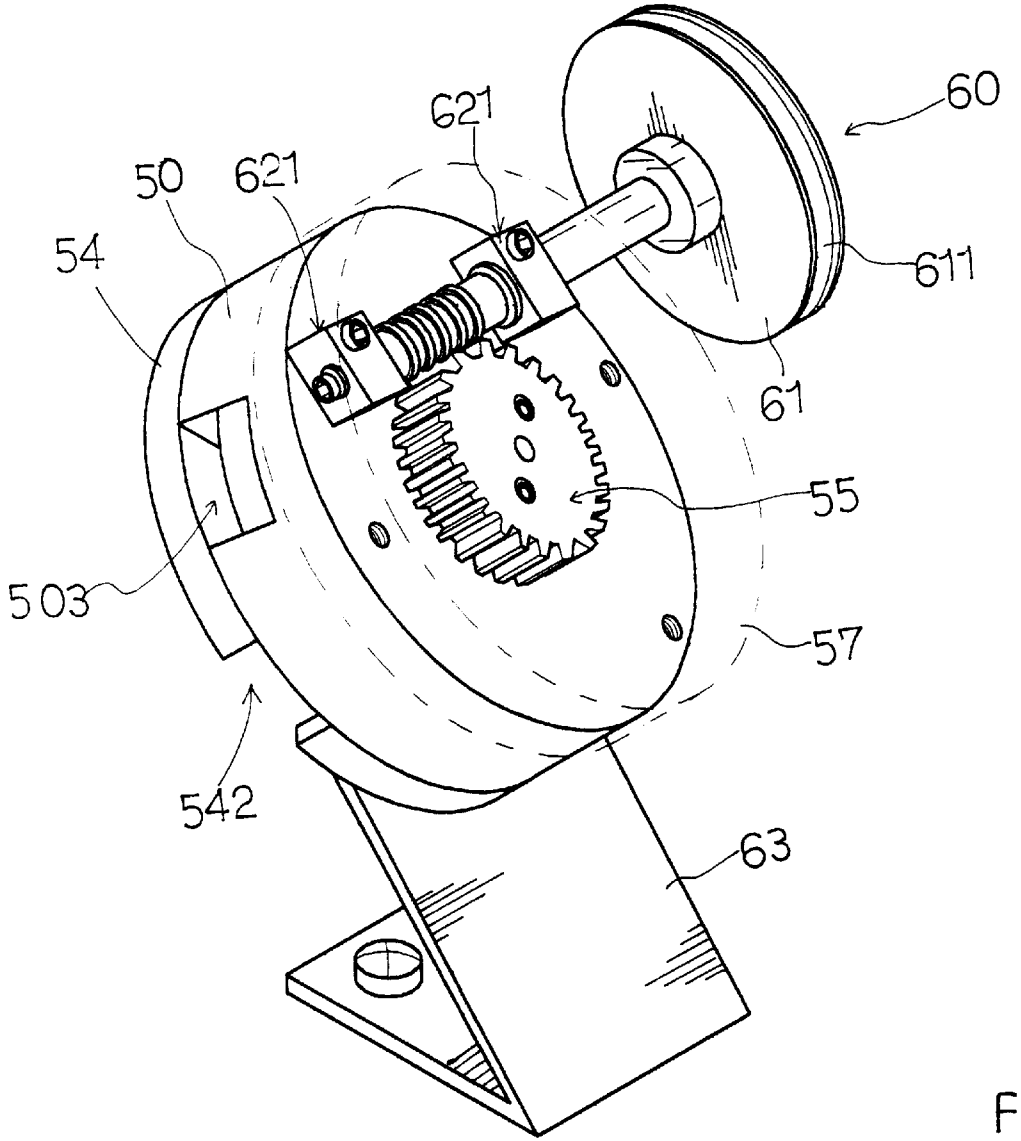
FIG. 6 is a schematic view of a micro-cutting device.

Referring to FIG. 6, the micro-cutting device 5 is provided on a left front side of the work table H by means of a securing seat 63, and is adapted to be driven by the driving element M. The micro-cutting device 5 includes front and rear covers 50, 54, a linkage mechanism 60 provided on the surface of the front cover 50, a steel plate 51 disposed between the front and rear covers 50, 54, a rubber packing plate 52, a rotary disk 53, and a protective cover 57 disposed in front of the front cover 50 (see FIG. 6*a*).

Figure 6A:
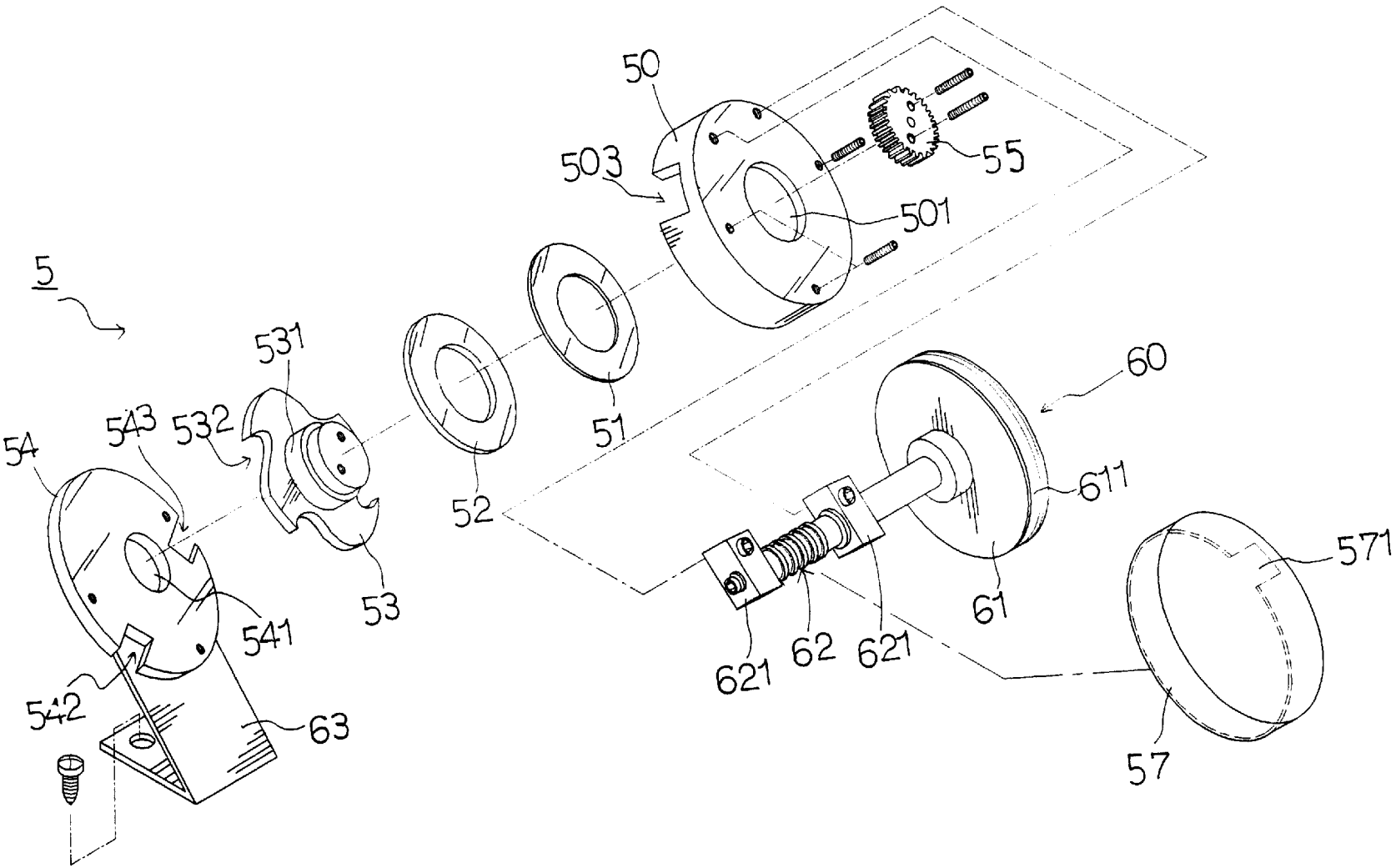
FIG. 6*a* is an exploded view of FIG. 6.
Figure 6B:
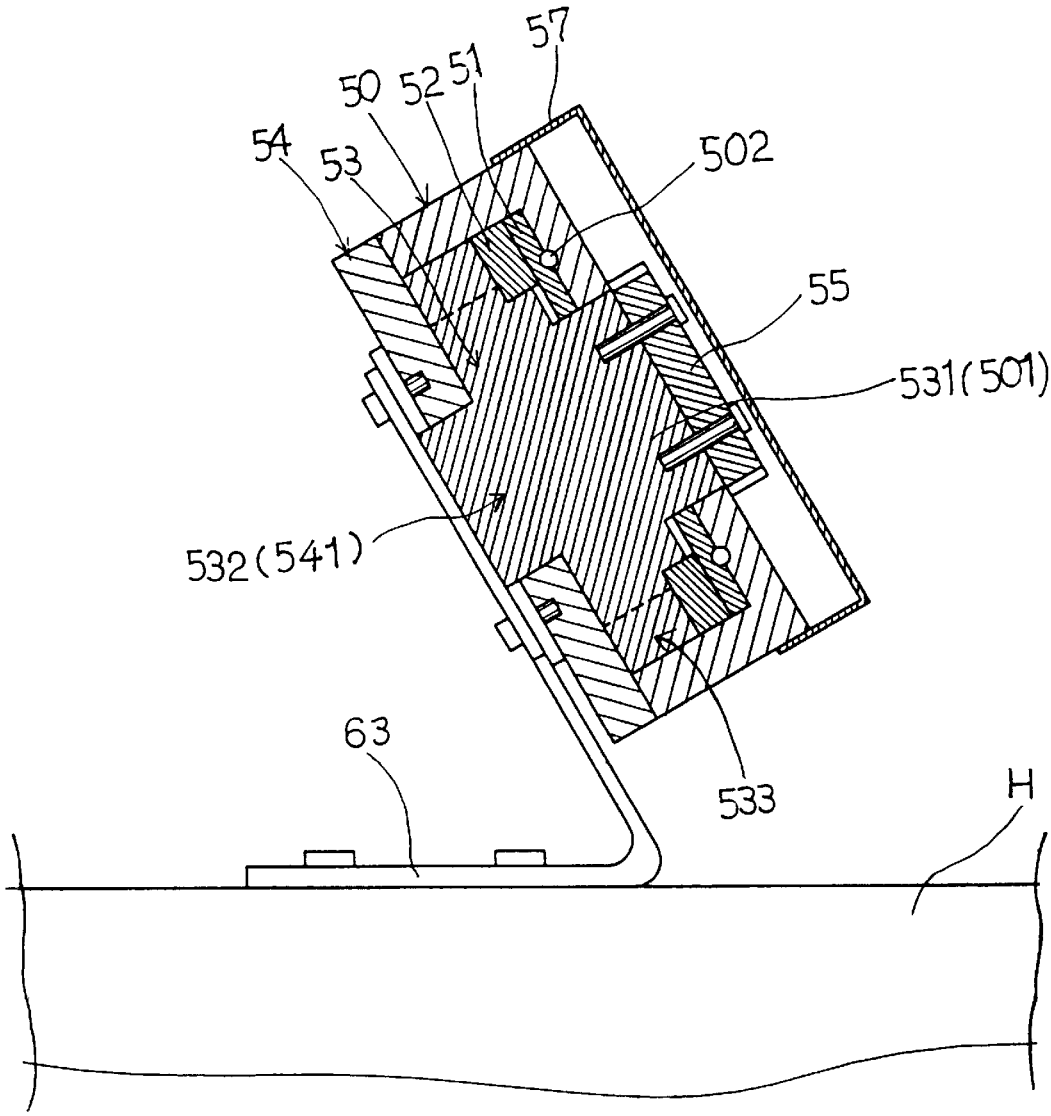
FIG. 6*b* is an assembled sectional view of FIG. 6.
Figure 6C:
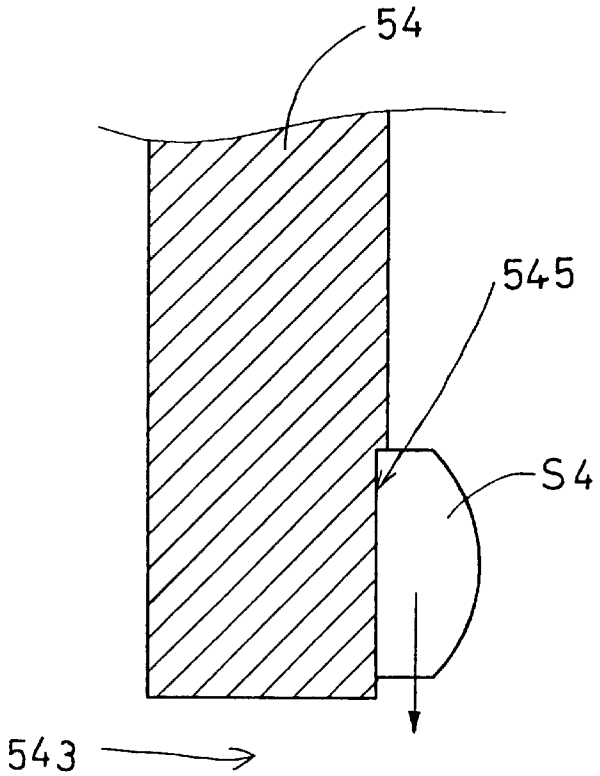
FIG. 6*c* is a schematic view illustrating operation of the micro-cutting device.
Figure 6C:
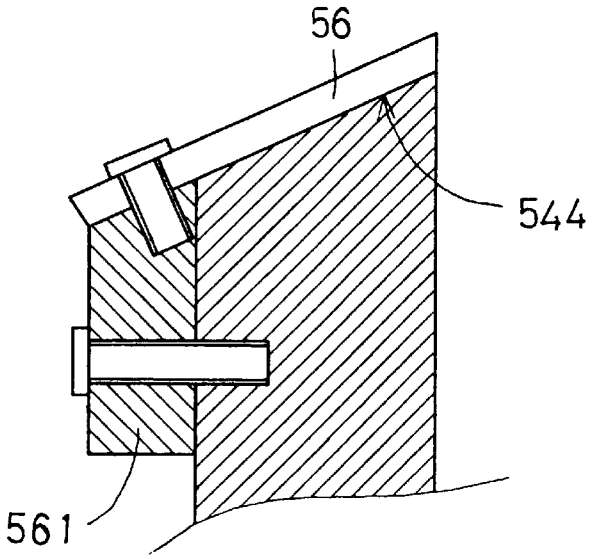

As shown in FIGS. 6 and 6*a*, the linkage mechanism 60 includes a screw rod 62 pivotally on a rod seat 61 secured on the front cover 50. One end of the screw rod 62 is secured to a spindle of the driven wheel 61. The circumference of the driven wheel 61 has a third cable receiving groove 611 for receiving the above-mentioned drive cable M2. The drive element M rotates the driven wheel 61 so that the screw rod 62 is rotated therewith. The screw rod 62 also brings a ratchet 55 to rotate therewith, the ratchet 55 having an inner side secured with the rotary disk 53 and an outer end engaging the screw rod 62. The protective cover 57 disposed on the front cover 50 is provided with an opening 571 for extension of the screw rod therethrough so that the linkage mechanism 60 can be covered and possible damage thereto or to the user may be avoided. Referring to FIG. 6b, the front and rear covers 50, 54 have a respective opening 501, 541 that is aligned with each other. An inner rear face of the front cover 50 is provided with an annular groove and a plurality of steel balls 502 distributed in a ring in the annular groove so as to reduce frictional resistance with the steel plate 51. Front and rear sides of the rotary disk 53 have front and rear projecting axles 531, 532 that can be fitted into the front and rear openings 501, 541 respectively. The ratchet 55 is screwably secured on the front projecting axle 531 to rotate the rotary disk 53. The steel plate 51 and the packing plate 52 are disposed between the front side of the rotary disk 53 and the inner rear face of the front cover 50. The steel plate 51 is contiguous to the steel balls 502, while the packing plate 52 is adapted to be adjacent to a plurality of carry grooves 533 of the rotary disk 53 (to serve as a spring-like member to urge against a rubber head S4). The carry grooves 533 are provided on the circumference of the rotary disk 53 for carrying the rubber head S4. An edge (left side) of the front cover 50 has an inlet 503 near an upper end thereof, whereas a longitudinal edge (left side) of the rear cover 54 has an outlet 542 near a lower end thereof. The inlet 503 is adapted to face the inner and outer sides of the carry grooves 533 of the rotary disk 53. The other longitudinal edge (right side) of the rear cover 54 has a notch 543 with an oblique edge 544 to which a cutter 56 is provided in a slanting manner. The edge of the cutter 56 extends from the rear side of the rear cover 54 in between the front and rear covers and is flushed with an inner side of the rear cover 54. The inner side of the rear cover 54 forms a very shallow depression 545 of about 0.1 mm to 0.5 mm prior to entry into the cutting range of the cutter 56 so as to serve as the basis for the cutting thickness of the rubber head S4 (see FIG. 6*c*).

Figure 6D:
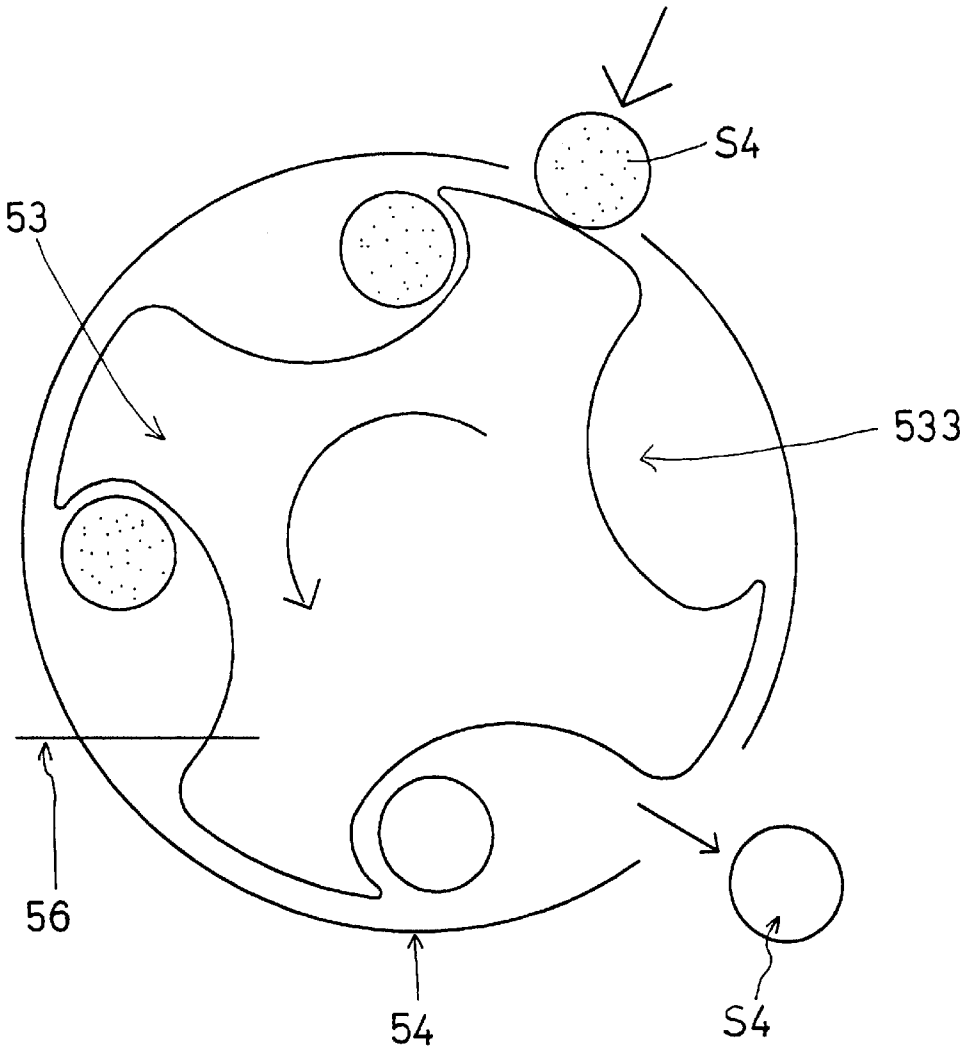
FIG. 6*d* is a schematic view showing the action of a rotary disk of FIG. 6*b*.

Referring to FIG. 2, the micro-cutting device 5 is obliquely erected on the work table H. In use, referring to FIGS. 6 and 6*d*, the rubber head S4 is pressed using a thumb sideways into the inlet 503 of the front cover 50. If the inlet 503 is adapted to be opposite to the rubber head, it can be carried away by a respective one of the carry grooves 533. If the inlet 503 is adapted to be at the edge of the rotary disk 53, the rubber head, as shown in FIG. 6*d*, will have one half thereof inside the inlet 503 that can be pressed into the following carry groove 533 when it comes along with the help of the thumb. When the rubber head S4 passes by the shallow depression 545, it will sink slightly, where the bottom side thereof is cut by the cutter 56 to be completely planar and flat. After cutting, the rubber head is brought by a respective one of the carry grooves 533 to the outlet 542. Since the micro-cutting device 5 is obliquely erected and since the outlet 542 is located at the left lower corner, the rubber head will fall of its own weight.

Figure 5:
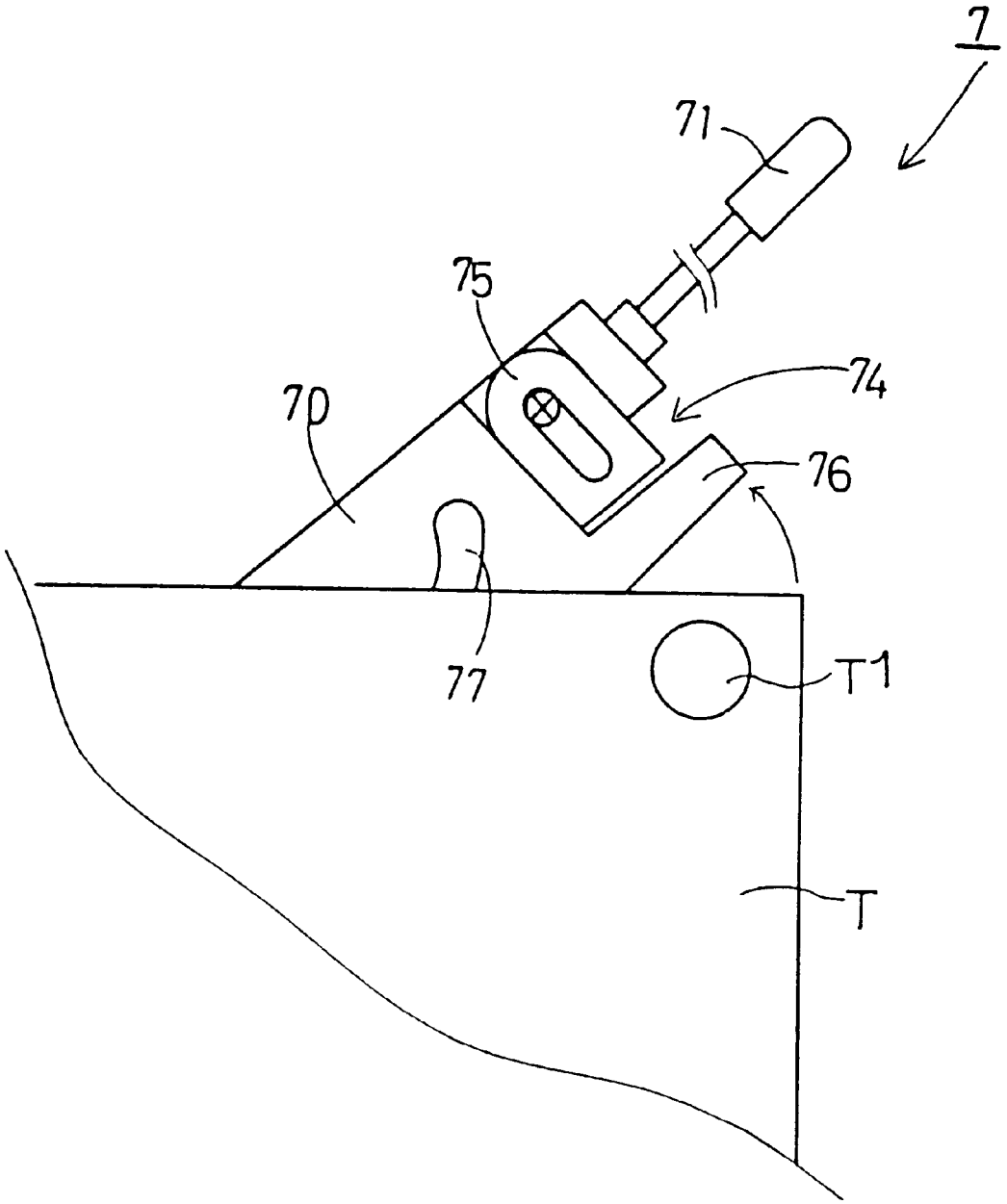
FIG. 5 illustrates an end cutting device from the front and from the side.
Figure 5B:
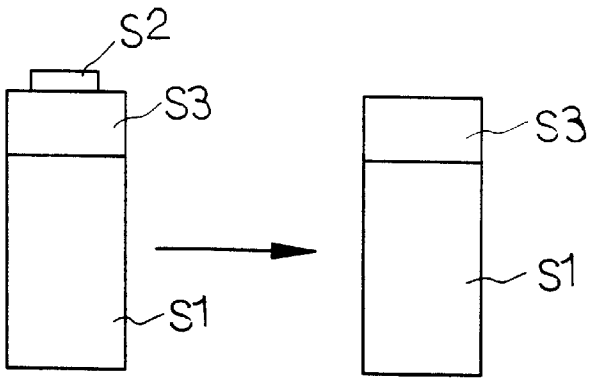
FIG. 5*b* illustrates the billiard cue prior to and after operation of the end cutting device.

Referring to FIG. 5, the end cutting device 7 is provided on a right rear side of the work table H, and includes a plate 70 that is pivotally connected to a rear side of the elongate plate T by means of a rear end pivot portion 73, a manipulating rod 71 secured to the other end of the plate 70, a cutter 75 disposed provided on the plate 70, and an elastic element 72 extended between the plate 70 and the elongate plate T. A placement seat 79 is disposed on the lower left side of the work table H, and is screwably secured in position on the work table H from below so that the body of the cue S may be placed thereon to reduce the load borne by the user's hand.

Figure 5A:
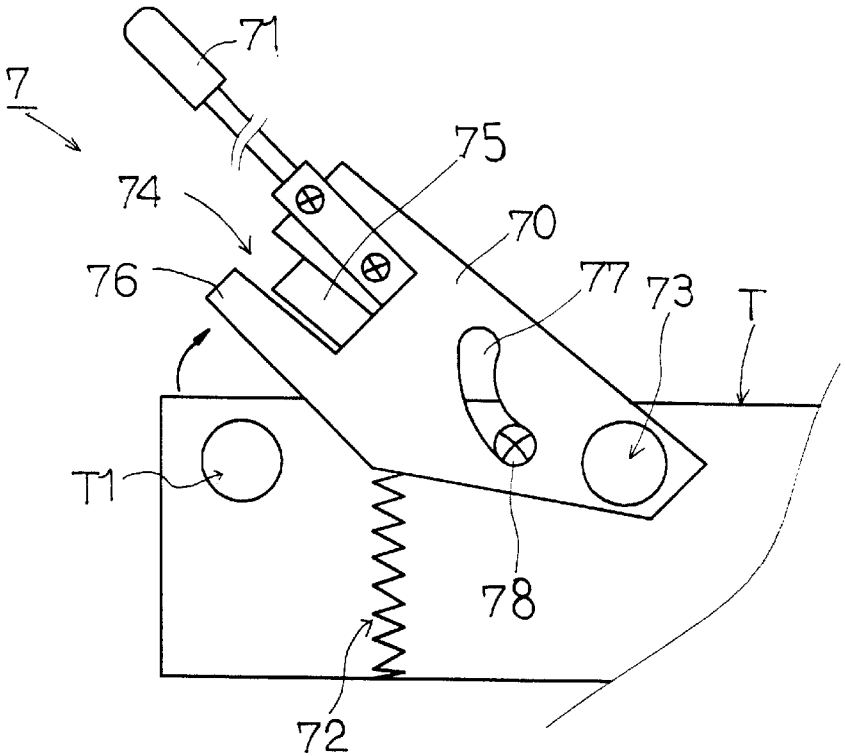
FIG. 5*a* is a rear view of FIG. 5.
Figure 5C:
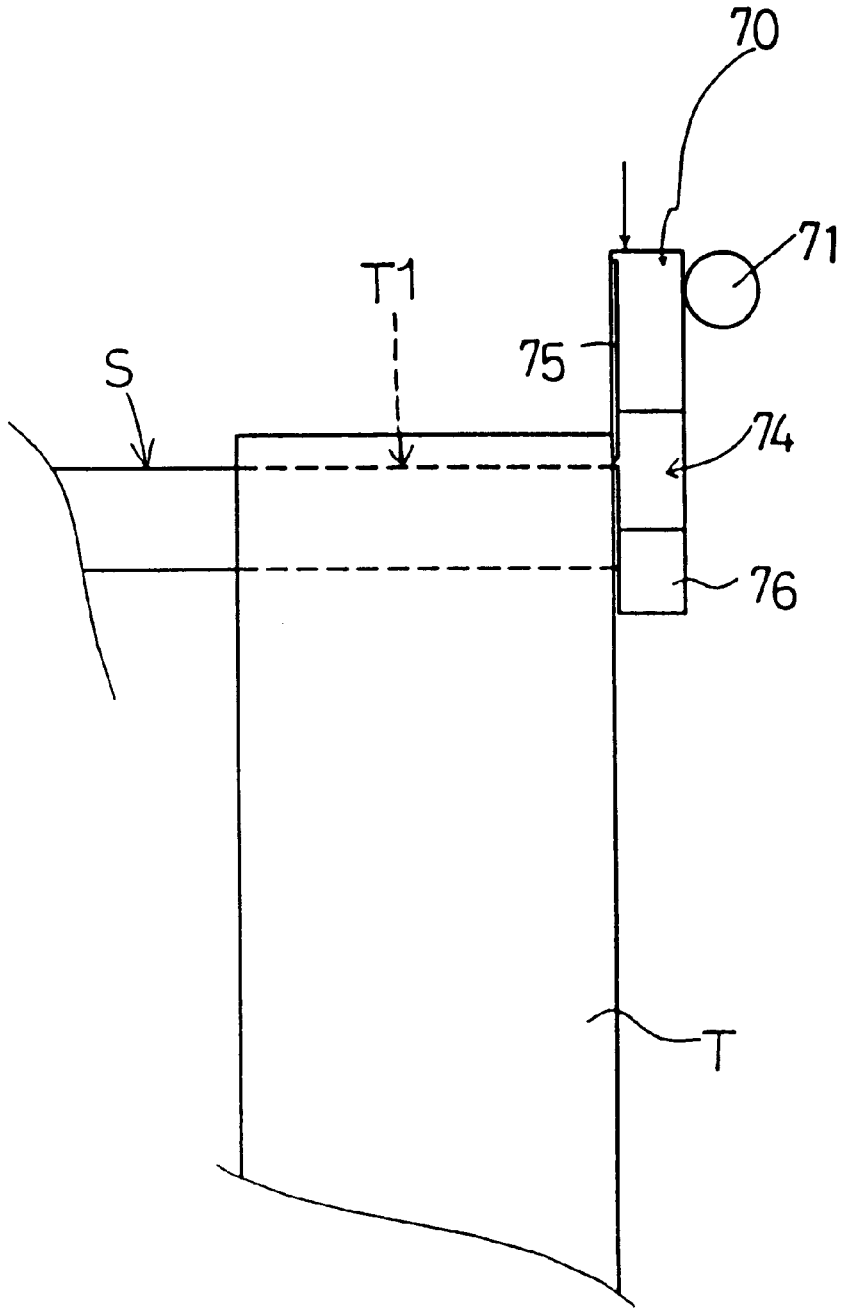
FIG. 5*c* illustrates a view of the end cutting device.

As shown in FIG. 5*a*, a left side of the plate 70 near its lower edge forms an urging portion 76 through an opening 74. The cutter 76 is inserted longitudinally in the opening 74 (see FIG. 5). An elongate curved slot 77 is formed near a tail end of the plate 70 at a suitable position. A positioning screw 78 is inserted through the curved slot 77 to be secured on the elongate plate T without being locked tight in the curved slot 77, so as to restrict the upward and downward displacement of the plate 70 during cutting. As shown in FIG. 5, the plate 70 is flushed against the elongate plate T with the urging portion 76 on the lower edge thereof defining a very small clearance (see the side view of FIG. 5) with the elongate plate T. Before operation, the bottom edge of the urging portion 76 of the end cutting device 7 substantially covers the upper portion of the action hole T1 (see FIG. 5*a*). After planing and edge cutting, the end of the cue to be repaired is inserted from the front side of the elongate plate T into the action hole T1, so that the rear end of the cue S urges against the urging portion 76 to be slightly projecting from the "exposed length" of the cutter 76. By pressing downwardly the plate 70 using the manipulating rod 71, the cutter 75 cuts the "exposed length" to achieve a very flat and even cue end.

In the present invention, the damaged portion of the cue S is firstly cut off to form a to-be-repaired end. By means of the positioning post 85 and the action hole L1, the to-be-repaired end of the cue S is extended from the action hole L1 a determined length (the exposed portion that is adjacent to the rod S2 of the cue shaft S1 is substantially as long as the plastic sleeve S3). By turning the inner and outer screw caps 86, 81 of the cue clamping mechanism 8 to clamp tightly the cue S (see FIG. 2*c*), by using the driving element M to bring the cue clamping mechanism 8, the cue S, and the micro-cutting device to rotate, and by moving the control rod of the planing device 1 in a transverse direction to cause the plane knife 20 to move proximate to the to-be-repaired end of the cue S, a rod S 2 of a smaller diameter than the cue shaft S1 can be obtained by planing (see FIG. 3*c*), and the diameter of the rod S2 is controlled by the two indentations 222 and the adjusting pin L2. The plastic sleeve S 3 is firmly fitted onto the rod S2 using a hammer. At this point, the plastic sleeve S3 and the cue shaft S1 must have different diameters. In other words, the edge of the striking end of the cue S is not even and the rear end of the cue S is also rugged and uneven. By moving the control rod 13 forwardly and rearwardly to control the second axial gear mechanism 100 to bring the elastic transverse mechanism 30 having the elastic shaft 40 to displace forwardly and rearwardly (the displacement of the cutter 36 being about 30 mm measured from the end of the cue so that the cue shaft S1 near the rod S2 has a small portion exposed on the outside and to be cut) and by moving the control rod 33 of the edge cutting device in a transverse direction, the cutter 36 and the bearing provided on the elastic shaft 40 are moved to approximate the to-be-repaired end so as to proceed with cutting between the exposed cue shaft S1 and the rod S2 fitted with the plastic sleeve S3 (i.e., the above-mentioned 30 mm). The bearing 35 urges against the cue shaft S1 to thereby limit the cutter to make the uneven portions of the cue shaft S1 even based upon the cue shaft S1 while displacing forwardly and rearwardly. In other words, the portion of the cue shaft S1 that has a slightly larger diameter than the diameter of the plastic sleeve S3 is cut to be flushed with the plastic sleeve S3. The to-be-repaired end of the cue S is then inserted into another action hole T1. The end cutting device 7 is used to trim the portion that projects slightly from the end of the cue S until it is flushed with the plastic sleeve S3. The micro-cutting device 5 is used to trim the uneven bottom side of the rubber head S4 to become even and level. The rubber head S4 is adhered to the rear end of the cue S, and all the steps of repairing the cue S are thus accomplished. If the diameter of the rubber head S4 is not consistent with that of the cue shaft 1, the edge cutting device 3 may be further used to trim the rubber head S4 until its diameter is the same as that of the cue shaft S1.

The prior art has the disadvantages that the repairing of the billiard cue is completely done by hand, which is time and labor consuming. Besides, the precision of the repairing steps is hard to control, and the rate of successful repair is low. But in the present invention, repair of the billiard cue is mechanized, which saves time and labor. Besides, the repair precision is consistent and high; the rate of unsuccessful repair is almost zero. It can therefore be appreciated that the present invention is indeed a vast improvement over the prior art.

Although the present invention has been illustrated and described with reference to the preferred embodiment thereof, it should be understood that it is in no way limited to the details of such embodiment but is capable of numerous modifications within the scope of the appended claims.

What is claimed is:

1. A cue repairing machine, comprising:

a work table having a longitudinal plate that is provided vertically thereon, said longitudinal plate having an action hole disposed at a substantially central portion thereof;

a positioning column fixedly provided at a rear portion of said work table and having an extension rod that extends transversely therethrough, said extension rod being aligned with said action hole;

a driving element having an axial end provided with an axle bush that is formed with two annular first cable receiving grooves;

a cue clamping mechanism provided on a rear side of said longitudinal plate and including a bearing that is provided in said action hole, a hollow fitting post that has one end secured in said bearing, a driven fitting seat that is fitted over said fitting post, an inner screw cap that is fitted in said fitting post, an outer screw cap that is coupled screwably to the other end of said fitting post, and an elastic clamping element that is provided between said fitting post and said outer screw cap, said driven fitting seat having a second cable receiving groove provided on an outer wall thereof, ends of one of drive cables being respectively received in a respective one of said first cable receiving grooves of said driving element and said second cable receiving groove, whereby said driven fitting seat can be brought to co-rotate with said driving element; said outer screw cap being driven screwably into a rear end of said fitting post, each of said outer screw cap and said fitting post having an interior formed with opposed tapered edges on opposite ends thereof; said elastic clamping element being inserted into the interior spaces of said outer screw cap and said fitting post, said elastic clamping element having two ends that will contract when subjected to an external pressure, said two ends of said elastic element being configured to be tapered so as to match said tapered edges of said outer screw cap and said fitting post, the contraction of said ends of said elastic clamping element being adjustable by adjusting the extent said outer screw cap is driven onto a rear one of said ends of said elastic clamping element and the pressure exerted by said tapered edges on said ends of said elastic clamping element, whereby a billiard cue disposed inside said elastic clamping element can be clamped tightly and brought to rotate by said cue clamping mechanism;

a planing device disposed on a right side of said action hole of said longitudinal plate and including a first axial gear driving mechanism that includes a hollow outer sleeve secured on said longitudinal plate, a central post fitted into said outer sleeve, a ratchet disposed on a bottom side of said outer sleeve, and a control rod for controlling rotation of said ratchet, a plane knife secured at a left end of said central post proximate to said action hole, and a limiting disk axially secured at the other end of said central post, said outer sleeve having an opening on a bottom side, two lower extension plates being disposed on both sides of said opening respectively, said central post having lower ratchet teeth formed on a bottom side thereof to correspond to said ratchet, said ratchet teeth being exposed through said opening of said outer sleeve, said plane knife being secured at one end of said central post, said limiting disk being axially secured at the other end thereof, said limiting disk being provided with two indentations of different depths, said longitudinal plate having an adjusting pin provided on one side thereof to fit into said indentations of said limiting disk, said control rod having a tail end provided with a shaft that is disposed in a perpendicular relationship to said control rod, said shaft being bolted between said two lower extension plates and being connected to said ratchet disposed between said lower extension plates, said ratchet engaging said ratchet teeth of said central post such that manipulation of said control rod can cause said ratchet to drive said central post to displace left and right, said plane knife having an edge oriented obliquely downward;

an edge cutting device provided on the other side of said action hole of said longitudinal plate and including a second axial gear mechanism that is substantially the same as said first axial gear mechanism of said planing device in structure, an elastic horizontal displacement mechanism that straddles over said second axial gear mechanism and has an elastic shaft, and a control rod that controls a central post of said second axial gear mechanism and said elastic shaft, in which an upper side of an outer sleeve of said second axial gear mechanism is provided with a longitudinally oriented elongate groove, a moving seat being screwably provided on one side of said outer sleeve of said second axial gear mechanism, said moving seat being provided with a recess, said central post of said second axial gear mechanism having an upper side provided with a screw hole in said elongate groove; said elastic horizontal displacement mechanism including a generally inverted U-shaped straddling seat, said elastic shaft mounted in said straddling seat, and a brake rod, said straddling seat having a bottom side straddling over the upper side of said outer sleeve of said second axial gear mechanism, an upper side of said straddling seat being formed with a transverse groove for receiving said elastic shaft, said straddling seat being secured on said screw hole of said central post of said second axial gear mechanism, whereby said second axial gear mechanism can bring said elastic transverse displacement mechanism to displace forwardly and rearwardly by means of said central post thereof;

said elastic shaft including a second sleeve that is secured on an inner side of said transverse groove and has a left end formed with a flange, a central rod that is inserted via a right end of said second sleeve and that has a larger flange and a smaller flange, and a first sleeve that is inserted via a left end of said first sleeve and that has a left end provided with a flange, said larger flange of said central rod abutting against the right end of said second sleeve, the smaller flange being located inside said second sleeve; a left end of said central rod extending out of said second sleeve, said first sleeve being fitted into the left end of said central rod and inserted into said second sleeve from the left end; inner and outer elastic elements being disposed respectively between said smaller flange of said central rod and the right end of said first sleeve, and between said flange at the left end of said first sleeve and said flange at the left end of said second sleeve, an upper edge of a right end of said central rod being formed with a notch and having a cutter screwably secured in said notch, said cutter having an edge oriented towards said action hole; a rear side of said left end of said central rod having a bearing provided thereon, said bearing having an edge being flush with said edge of said cutter, said bearing being utilized to limit the cutting extent of said billiard cue; said brake rod having a substantially intermediate section thereof bolted in position so as to control, via said outer elastic element, said first sleeve and said central rod to project to a right side of said straddling seat, and to control, via said inner elastic element and said central rod that utilizes said bearing to abut against a cue shaft of said billiard cue, said central rod to extend or retract elastically;

a micro-cutting device provided on said work table in any suitable position such that it can be driven by said driving element, and including front and rear covers, a linkage mechanism provided on a surface of said front cover, a steel plate disposed between said front and rear covers, a packing plate, a rotary disk, and a protective cover disposed in front of said front cover, in which said linkage mechanism includes a screw rod pivotally on a rod seat secured on said front cover, one end of said screw rod being secured to a spindle of a driven wheel, said driven wheel being circumferentially provided with a third cable receiving groove for receiving a respective one of said drive cables, said driving element rotating said driven wheel so that said screw rod is rotated therewith, said screw rod further bringing a ratchet to rotate therewith, said ratchet having an inner side secured with said rotary disk and an outer end engaging said screw rod, said protective cover being disposed on said front cover and being provided with an opening for extension of said screw rod therethrough so that said linkage mechanism can be covered, said front and rear covers having a respective opening that is aligned with each other, an inner rear face of said front cover being provided with a plurality of steel balls, front and rear sides of said rotary disk having front and rear projecting axles that can be fitted into the front and rear openings, said ratchet being screwably secured on said front projecting axle to rotate said rotary disk, said steel plate and said packing plate being disposed between the front side of said rotary disk and the inner rear face of said front cover, said steel plate being disposed contiguous to said steel balls, said packing plate being disposed contiguous to said rotary disk; said rotary disk being circumferentially provided with a plurality of carry grooves for carrying a rubber head of said billiard cue, an edge of said front cover having an inlet near an upper end thereof, a longitudinal edge of said rear cover having an outlet near a lower end thereof, said inlet being adapted to face the inner and outer sides of a plurality of carry grooves of said rotary disk, the other longitudinal edge of said rear cover having a cutter obliquely mounted thereon, said cutter having an edge extending from the rear side of said rear cover between said front and rear covers and being flush with an inner side of said rear cover, the inner side of said rear cover forming a very shallow depression to serve as the basis for the cutting thickness of said rubber head; said micro-cutting device being obliquely erected on said work table such that said rubber head, after cutting, can be brought to said outlet by said rotary disk to fall out of its own weight; and an end cutting device provided on a front or rear side of said elongate plate and including a plate having a tail end pivotally connected to said elongate plate, a manipulating rod secured to the other end of said plate, a longitudinally oriented cutter being disposed on said plate, and an elastic element extended between said plate and said elongate plate, a placement seat being further on a lower left side of said work table, in which the other side of said plate near a lower edge thereof forms an urging portion through an opening, said cutter being inserted in said opening, a curved slot being formed near a tail end of said plate at a suitable position, a positioning screw being inserted through said curved slot to be secured on the elongate plate in a loosened manner so as to restrict the upward and downward displacement of said plate during cutting; said plate being flushed against the elongate plate with said urging portion on the lower edge thereof defining a very small clearance with said elongate plate, said urging portion having a bottom edge thereof substantially covering the upper portion of said action hole prior to action of said end cutting device;

said positioning post and an action hole being utilized to allow a to-be-repaired end of said billiard cue to extend from said action hole a determined length, said inner and outer screw caps of said cue clamping mechanism being turned to tightly grip said billiard cue, said driving element being employed to bring said cue clamping mechanism and said billiard cue to rotate, said control rod of said planing device being moved in a transverse direction to cause said plane knife to move proximate to said to-be-repaired end of said billiard cue to achieve a rod of a smaller diameter than that of said cue shaft, said control rod being moved forwardly and rearwardly to control said second axial gear mechanism to bring said elastic transverse mechanism having said elastic shaft to displace forwardly and rearwardly, said control rod of said edge cutting device being moved in a transverse direction so that said cutter and said bearing provided on said elastic shaft are moved to be proximate said to-be-repaired end so as to proceed with cutting between the exposed cue shaft and said rod fitted with said plastic sleeve, so that the part of said cue shaft that has a diameter larger than that of said plastic sleeve is cut flush with said plastic sleeve, said billiard cue that is inserted into said action hole of said elongate plate utilizing said end cutting device to trim the portion that projects slightly from a rear end of said billiard cue to become even, said rubber head being pressed in via said inlet of said micro-cutting device so that said rotary disk is rotated by said linkage mechanism driven by said driving element, whereby said carry grooves of said rotary disk can bring said rubber head to undergo cutting by said cutter, said cut rubber head being adhered to an uneven portion of an adhering side of a cue end of said billiard cue.

2. A billiard cue repairing machine, comprising:

a work table having a longitudinal plate that is provided vertically thereon, said longitudinal plate having an action hole disposed at a substantially central portion thereof;

a positioning column fixedly provided at a rear portion of said work table and having an extension rod that extends transversely therethrough, said extension rod being aligned with said action hole;

a driving element having an axial end provided with an axle bush that is formed with two annular first cable receiving grooves;

a cue clamping mechanism provided on a rear side of said longitudinal plate and including a bearing that is provided in said action hole, a hollow fitting post that has one end secured in said bearing, a driven fitting seat that is fitted over said fitting post, an inner screw cap that is fitted in said fitting post, an outer screw cap that is coupled screwably to the other end of said fitting post, and an elastic clamping element that is provided between said fitting post and said outer screw cap, said driven fitting seat having a second cable receiving groove provided on an outer wall thereof, ends of one of drive cables being respectively received in a respective one of said first cable receiving grooves of said driving element and said second cable receiving groove, whereby said driven fitting seat can be brought to co-rotate with said driving element; said outer screw cap being driven screwably into a rear end of said fitting post, each of said outer screw cap and said fitting post having an interior formed with opposed tapered edges on opposite ends thereof; said elastic clamping element being inserted into the interior spaces of said outer screw cap and said fitting post, said elastic clamping element having two ends that will contract when subjected to an external pressure, said two ends of said elastic element being configured to be tapered so as to match said tapered edges of said outer screw cap and said fitting post, the contraction of said ends of said elastic clamping element being adjustable by adjusting the extent said outer screw cap is driven onto a rear one of said ends of said elastic clamping element and the pressure exerted by said tapered edges on said ends of said elastic clamping element, whereby a billiard cue disposed inside said elastic clamping element can be clamped tightly and brought to rotate by said cue clamping mechanism;

a planing device disposed on a right side of said action hole of said longitudinal plate and including a first axial gear driving mechanism that includes a hollow outer sleeve secured on said longitudinal plate, a central post fitted into said outer sleeve, a ratchet disposed on a bottom side of said outer sleeve, and a control rod for controlling rotation of said ratchet, a plane knife secured at a left end of said central post proximate to said action hole, and a limiting disk axially secured at the other end of said central post, said outer sleeve having an opening on a bottom side, two lower extension plates being disposed on both sides of said opening respectively, said central post having lower ratchet teeth formed on a bottom side thereof to correspond to said ratchet, said ratchet teeth being exposed through said opening of said outer sleeve, said plane knife being secured at one end of said central post, said limiting disk being axially secured at the other end thereof, said limiting disk being provided with two indentations of different depths, said longitudinal plate having an adjusting pin provided on one side thereof to fit into said indentations of said limiting disk, said control rod having a tail end provided with a shaft that is disposed in a perpendicular relationship to said control rod, said shaft being bolted between said two lower extension plates and being connected to said ratchet disposed between said lower extension plates, said ratchet engaging said ratchet teeth of said central post such that manipulation of said control rod can cause said ratchet to drive said central post to displace left and right, said plane knife having an edge oriented obliquely downward;

an edge cutting device provided on the other side of said action hole of said longitudinal plate and including a second axial gear mechanism that is substantially the same as said first axial gear mechanism of said planing device in structure, an elastic horizontal displacement mechanism that straddles over said second axial gear mechanism and has an elastic shaft, and a control rod that controls a central post of said second axial gear mechanism and said elastic shaft, in which an upper side of an outer sleeve of said second axial gear mechanism is provided with a longitudinally oriented elongate groove, a moving seat being screwably provided on one side of said outer sleeve of said second axial gear mechanism, said moving seat being provided with a recess, said central post of said second axial gear mechanism having an upper side provided with a screw hole in said elongate groove; said elastic horizontal displacement mechanism including a generally inverted U-shaped straddling seat, said elastic shaft mounted in said straddling seat, and a brake rod, said straddling seat having a bottom side straddling over the upper side of said outer sleeve of said second axial gear mechanism, an upper side of said straddling seat being formed with a transverse groove for receiving said elastic shaft, said straddling seat being secured on said screw hole of said central post of said second axial gear mechanism, whereby said second axial gear mechanism can bring said elastic transverse displacement mechanism to displace forwardly and rearwardly by means of said central post thereof; said elastic shaft including a second sleeve that is secured on an inner side of said transverse groove and has a left end formed with a flange, a central rod that is inserted via a right end of said second sleeve and that has a larger flange and a smaller flange, and a first sleeve that is inserted via a left end of said first sleeve and that has a left end provided with a flange, said larger flange of said central rod abutting against the right end of said second sleeve, the smaller flange being located inside said second sleeve; a left end of said central rod extending out of said second sleeve, said first sleeve being fitted into the left end of said central rod and inserted into said second sleeve from the left end; inner and outer elastic elements being disposed respectively between said smaller flange of said central rod and the right end of said first sleeve, and between said flange at the left end of said first sleeve and said flange at the left end of said second sleeve, an upper edge of a right end of said central rod being formed with a notch and having a cutter screwably secured in said notch, said cutter having an edge oriented towards said action hole; a rear side of said left end of said central rod having a bearing provided thereon, said bearing having an edge being flushed with said edge of said cutter, said bearing being utilized to limit the cutting extent of said billiard cue; said brake rod having a substantially intermediate section thereof bolted in position so as to control, via said outer elastic element, said first sleeve and said central rod to project to a right side of said straddling seat, and to control, via said inner elastic element and said central rod that utilizes said bearing to abut against a cue shaft of said billiard cue, said central rod to extend or retract elastically;

said positioning post and an action hole being utilized to allow a to-be-repaired end of said billiard cue to extend from said action hole a determined length, said inner and outer screw caps of said cue clamping mechanism being turned to tightly grip said billiard cue, said driving element being employed to bring said cue clamping mechanism and said billiard cue to rotate, said control rod of said planing device being moved in a transverse direction to cause said plane knife to move proximate to said to-be-repaired end of said billiard cue to achieve a rod of a smaller diameter than that of said cue shaft, said control rod being moved forwardly and rearwardly to control said second axial gear mechanism to bring said elastic transverse mechanism having said elastic shaft to displace forwardly and rearwardly, said control rod of said edge cutting device being moved in a transverse direction so that said cutter and said bearing provided on said elastic shaft are moved to be proximate said to-be-repaired end so as to proceed with cutting between the exposed cue shaft and said rod fitted with said plastic sleeve, so that the portion of said cue shaft that has a diameter larger than that of said plastic sleeve is cut flush with said plastic sleeve.

3. A billiard cue repairing machine as defined in claim 2, further comprising a micro-cutting device provided on said work table in any suitable position such that it can be driven by said driving element, and including front and rear covers, a linkage mechanism provided on a surface of said front cover, a steel plate disposed between said front and rear covers, a packing plate, a rotary disk, and a protective cover disposed in front of said front cover, in which said linkage mechanism includes a screw rod pivotally on a rod seat secured on said front cover, one end of said screw rod being secured to a spindle of a driven wheel, said driven wheel being circumferentially provided with a third cable receiving groove for receiving a respective one of said drive cables, said drive element rotating said driven wheel so that said screw rod is rotated therewith, said screw rod further bringing a ratchet to rotate therewith, said ratchet having an inner side secured with said rotary disk and an outer end engaging said screw rod, said protective cover being disposed on said front cover and being provided with an opening for extension of said screw rod therethrough so that said linkage mechanism can be covered;

said front and rear covers having a respective opening that is aligned with each other, an inner rear face of said front cover being provided with a plurality of steel balls, front and rear sides of said rotary disk having front and rear projecting axles that can be fitted into the front and rear openings, said ratchet being screwably secured on said front projecting axle to rotate said rotary disk, said steel plate and said packing plate being disposed between the front side of said rotary disk and the inner rear face of said front cover, said steel plate being disposed contiguous to said steel balls, said packing plate being disposed contiguous to said rotary disk;

said rotary disk being circumferentially provided with a plurality of carry grooves for carrying a rubber head of said billiard cue, an edge of said front cover having an inlet near an upper end thereof, a longitudinal edge of said rear cover having an outlet near a lower end thereof, said inlet being adapted to face the inner and outer sides of said carry grooves of said rotary disk, the other longitudinal edge of said rear cover having a cutter obliquely mounted thereon, said cutter having an edge extending from the rear side of said rear cover between said front and rear covers and being flushed with an inner side of said rear cover, the inner side of said rear cover forming a very shallow depression to serve as the basis for the cutting thickness of said rubber head;

said micro-cutting device being obliquely erected on said work table such that said rubber head, after cutting, can be brought to said outlet by said rotary disk to fall out of its own weight;

said micro-cutting device allowing easy and independent cutting of said adhering side of said rubber head of said billiard cue so that said cut rubber head can be adhered to said cut rear end of said billiard cue.

4. A billiard cue repairing machine as defined in claim 2, further comprising an end cutting device provided on a front or rear side of said elongate plate and including a plate having a tail end pivotally connected to said elongate plate, a manipulating rod secured to the other end of said plate, a longitudinally oriented cutter being disposed on said plate, and an elastic element extended between said plate and said elongate plate, a placement seat being further on a lower left side of said work table, the other side of said plate near a lower edge thereof forming an urging portion through an opening, said cutter being inserted in said opening, a curved slot being formed near a tail end of said plate at a suitable position, a positioning screw being inserted through said curved slot to be secured on the elongate plate in a loosened manner so as to restrict the upward and downward displacement of said plate during cutting; said plate being flushed against the elongate plate with said urging portion on the lower edge thereof defining a very small clearance with said elongate plate, said urging portion having a bottom edge thereof substantially covering the upper portion of said action hole prior to action of said end cutting device, whereby the rear end of said billiard cue can be extended through another action hole to project slightly from a rear side of said action hole to serve as a basis for said cutter in cutting.

* * * * *